US011486123B2

(12) United States Patent
Tone et al.

(10) Patent No.: US 11,486,123 B2
(45) Date of Patent: Nov. 1, 2022

(54) FLUSH TOILET

(71) Applicant: TOTO LTD., Kitakyushu (JP)

(72) Inventors: Yusuke Tone, Kitakyushu (JP); Shu Kashirajima, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 17/411,135

(22) Filed: Aug. 25, 2021

(65) Prior Publication Data

US 2022/0064923 A1 Mar. 3, 2022

(30) Foreign Application Priority Data

Aug. 28, 2020 (JP) ..... JP2020-144895

(51) Int. Cl.
*E03D 1/28* (2006.01)
*E03D 1/30* (2006.01)

(52) U.S. Cl.
CPC *E03D 1/28* (2013.01); *E03D 1/30* (2013.01)

(58) Field of Classification Search
CPC .... E03D 1/28; E03D 1/30; E03D 1/01; E03D 1/012; E03D 1/0125; E03D 2201/20
See application file for complete search history.

(56) References Cited

U.S. PATENT DOCUMENTS

2009/0313750 A1 12/2009 Okubo et al.
2015/0159356 A1* 6/2015 Fukuya ..... E03D 5/01 4/329

FOREIGN PATENT DOCUMENTS

| | | | |
|---|---|---|---|
| CN | 107816097 A | * | 3/2018 |
| JP | 2009-30405 A | | 2/2009 |
| JP | 2014-114627 A | | 6/2014 |
| JP | 2015-124583 A | | 7/2015 |

* cited by examiner

*Primary Examiner* — Janie M Loeppke
(74) *Attorney, Agent, or Firm* — BakerHostetler

(57) ABSTRACT

A flush toilet includes a toilet main body and a tank device. The tank device includes a storage tank, and a water supply unit configured to supply flush water to the storage tank. The storage tank includes a first upper surface including a water passage port through which the flush water supplied from the water supply unit flows into the storage tank, a second upper surface that is lower than the first upper surface, and a third upper surface that is provided between the first upper surface and the second upper surface and that is lower than the second upper surface. The storage tank further includes an air vent unit that is provided at the second upper surface and that is configured to purge air from the storage tank.

4 Claims, 17 Drawing Sheets

FLUSH TOILET

CROSS REFERENCE TO RELATED APPLICATION

This application claims benefit of priority to Japanese Patent Application No. 2020-144895, filed on Aug. 28, 2020, the entire content of which is incorporated herein by reference.

FIELD OF THE INVENTION

The present invention relates to a flush toilet, and more particularly, to a flush toilet for discharging waste with flush water.

BACKGROUND OF THE INVENTION

Conventionally, as flush toilets for discharging waste with flush water, those that feed, under pressure, flush water that is stored in a storage tank to a toilet main body by a pump to perform toilet flushing are known, as described in Patent Document 1 (Japanese Patent Laid-Open No. 2009-30405) and Patent Document 2 (Japanese Patent Laid-Open No. 2014-114627), for example.

A water supply unit that enables water to be supplied to the storage tank is provided at the storage tank of a conventional flush toilet as described above. The water supply unit is separated from the inside of the storage tank to prevent flush water in the storage tank from flowing backward.

However, with a conventional flush toilet as described above, in the case where a top surface of the storage tank is flat, if the storage tank is installed in a tilted manner due to manufacturing error of the toilet main body or assembly error of the storage tank and the toilet main body, for example, there is a problem that an air lock is formed on a tilted side. Accordingly, there is a problem that the amount of flush water stored in the storage tank is reduced or is varied depending on the volume of the air lock. Furthermore, when the air lock is formed in the storage tank, there is a problem that, when the flush water in the storage tank rises at the time of water supply to the storage tank, the air lock may be captured into the flush water, thereby making abnormal sounds. Accordingly, there is a demand to prevent generation of an air lock in the storage tank even in a state where the storage tank is tilted.

Accordingly, the present invention has been made in view of the problems of the conventional art and the demand as described above, and is aimed at providing a flush toilet that is capable of preventing an air lock that is due to tilting of a storage tank to thereby allow a greater amount of flush water to be stored in the storage tank and to prevent generation of abnormal sounds that are due to the air lock.

SUMMARY OF THE INVENTION

To solve the problems as described above, the present invention is a flush toilet for discharging waste with flush water, the flush toilet comprising: a toilet main body including a bowl configured to receive waste, and a discharge trap configured to discharge the waste in the bowl; and a tank device configured to supply flush water to the toilet main body, wherein the tank device includes a storage tank provided behind the toilet main body and above a floor surface, the storage tank being configured to store the flush water to be supplied to the toilet main body, the tank device further includes a water supply unit configured to supply the flush water to the storage tank, the storage tank includes a first upper surface, a second upper surface, and a third upper surface, the first upper surface including a water passage port through which the flush water supplied from the water supply unit flows into the storage tank, the second upper surface being lower than the first upper surface, and the third upper surface being provided between the first upper surface and the second upper surface and being lower than the second upper surface, and the storage tank further includes an air vent unit provided at the second upper surface, the air vent unit being configured to purge air from the storage tank. According to the present invention configured in the above manner, first, even if an air lock is formed inside the storage tank at the time of supply of water from the water supply unit to the storage tank, the water passage port provided in the first upper surface of the storage tank may function as an air vent port that facilitates escape of air of the air lock. Furthermore, flush water that is supplied from the water supply unit flows into the storage tank after passing through the water passage port in the first upper surface of the storage tank, and a water level in the storage tank is thereby raised. The entire upper surface of the storage tank is formed unevenly due to the first upper surface where the water passage port is provided, the second upper surface that is lower than the first upper surface, and the third upper surface that is lower than the second upper surface and that is provided between the first upper surface and the second upper surface. Accordingly, for example, when the water level, in the storage tank, that is lower than the third upper surface rises and reaches the third upper surface, and then, further rises to a height position between a height position of the third upper surface and a height position of the second upper surface, a state is reached where the air lock is easily formed between the water surface and the second upper surface. However, because the air vent unit is provided at the second upper surface of the storage tank, air in the storage tank can be purged by the air vent unit. Accordingly, the air lock between the water surface inside the storage tank and the second upper surface may be released to outside through the air vent unit. Accordingly, when the water level, in the storage tank, that is lower than the third upper surface rises and reaches the third upper surface and further rises to a height position between the height position of the third upper surface and the height position of the second upper surface, air of the air lock in the storage tank may be allowed by the air vent unit to easily escape. Therefore, thanks to the air vent unit as described above, generation of the air lock in the storage tank may be effectively prevented. Furthermore, generation of abnormal sounds due to the air lock inside the storage tank (such as abnormal sounds that are generated when the air lock inside the storage tank is captured during water supply, abnormal sounds that are generated at the time of deaeration of the air of the air lock from the water passage port (degassing sounds), and the like) may also be effectively prevented. Furthermore, the amount of flush water that is supplied from the water supply unit and stored in the storage tank may be prevented from being reduced or varied due to the air lock in the storage tank. Accordingly, a greater amount of flush water can be stored in the storage tank.

Next, the present invention is a flush toilet for discharging waste with flush water, the flush toilet comprising: a toilet main body including a bowl configured to receive waste, and a discharge trap configured to discharge the waste in the bowl; and a tank device configured to supply flush water to the toilet main body, wherein the tank device includes a storage tank provided behind the toilet main body and above a floor surface, the storage tank being configured to store the flush water to be supplied to the toilet main body, the tank device further includes a water supply unit configured to supply the flush water to the storage tank, the storage tank includes a first upper surface and a second upper surface, the first upper surface including a water passage port through which the flush water supplied from the water supply unit flows into the storage tank, and the second upper surface being lower than the first upper surface, and the storage tank further includes an air vent unit provided at the second upper surface, the air vent unit being configured to purge air from the storage tank. According to the present invention configured in the above manner, first, even if an air lock is formed inside the storage tank at the time of supply of water from the water supply unit to the storage tank, the water passage port provided in the first upper surface of the storage tank may function as an air vent port that facilitates escape of air of the air lock. Furthermore, flush water that is supplied from the water supply unit flows into the storage tank after passing through the water passage port in the first upper surface of the storage tank, and a water level in the storage tank is thereby raised. The entire upper surface of the storage tank is formed unevenly due to the first upper surface where the water passage port is provided, and the second upper surface that is lower than the first upper surface. Accordingly, in a state where the water level inside the storage tank is lower than the second upper surface, a state is temporarily reached where the air lock is easily formed between the water surface and the second upper surface. However, because the air vent unit is provided at the second upper surface of the storage tank, air in the storage tank can be purged by the air vent unit. Accordingly, the air lock between the water surface inside the storage tank and the second upper surface may be released to outside through the air vent unit. Accordingly, when the water level, in the storage tank, that is lower than the second upper surface rises to close to the second upper surface, air of the air lock in the storage tank may be allowed by the air vent unit to easily escape. Therefore, thanks to the air vent unit as described above, generation of the air lock in the storage tank may be effectively prevented. Furthermore, generation of abnormal sounds due to the air lock inside the storage tank (such as abnormal sounds that are generated when the air lock inside the storage tank is captured during water supply, abnormal sounds that are generated at the time of deaeration of the air of the air lock from the water passage port (degassing sounds), and the like) may also be effectively prevented. Furthermore, the amount of flush water that is supplied from the water supply unit and stored in the storage tank may be prevented from being reduced or varied due to the air lock in the storage tank. Accordingly, a greater amount of flush water can be stored in the storage tank.

In the present invention, preferably, the storage tank has an asymmetrical shape in a left-right direction so as to include a large tank section and a small tank section, the large tank section being disposed on a large-capacity side of the storage tank when the storage tank is divided into two at a center in the left-right direction, and the small tank section being disposed on a small-capacity side of the storage tank when the storage tank is divided into two at the center in the left-right direction, and the first upper surface is located on an upper surface of the large tank section, and the second upper surface is located on an upper surface of the small tank section. According to the present invention configured in the above manner, because the storage tank has a shape that is asymmetrical in the left-right direction due to the large tank section and the small tank section, the amount of stored water in the large tank section and the amount of stored water in the small tank section are different in the left-right direction. Accordingly, the storage tank is in a state where the entire storage tank is easily tilted with outside of the large tank section with a large amount of stored water (large weight) lowered relative to the center of gravity of the storage tank and outside of the small tank section with a small amount of stored water (small weight) raised relative to the center of gravity of the storage tank. With such tilting of the entire storage tank, escape of air of the air lock especially at an upper part in the small tank section of the storage tank from the air vent unit at the upper surface (the second upper surface) of the small tank section may be facilitated. Accordingly, the air lock between the water surface in the small tank section of the storage tank and the second upper surface may be released to outside through the air vent unit. Accordingly, generation of the air lock inside the storage tank (especially inside the small tank section) may be effectively prevented by the air vent unit. Furthermore, generation of abnormal sounds due to the air lock inside the storage tank (such as abnormal sounds that are generated when the air lock inside the storage tank is captured during water supply, abnormal sounds that are generated at the time of deaeration of the air of the air lock from the water passage port (degassing sounds), and the like) may also be effectively prevented. Accordingly, generation of abnormal sounds due to the air lock inside the storage tank (such as abnormal sounds that are generated when the air lock inside the small tank section of the storage tank is captured during water supply to the storage tank, abnormal sounds that are generated at the time of deaeration of the air of the air lock inside the small tank section of the storage tank from the water passage port in the upper surface (the first upper surface) of the large tank section (degassing sounds), and the like) may also be effectively prevented. Furthermore, the amount of flush water that is supplied from the water supply unit and stored in the large tank section and the small tank section of the storage tank may be prevented from being reduced or varied due to the air lock in the storage tank (especially in the small tank section). Accordingly, a greater amount of flush water may be stored in the large tank section and the small tank section of the storage tank. Moreover, because the entire storage tank is allowed to have a shape that is asymmetrical in the left-right direction due to the large tank section and the small tank section of the storage tank, freedom may be increased in relation to design and layout of peripheral units to be arranged in the periphery of the storage tank of the tank device.

With the flush toilet of the present invention, an air lock that is due to tilting of the storage tank may be prevented, and thus, a greater amount of flush water may be stored in the storage tank, and also, generation of abnormal sounds that are due to the air lock may be prevented.

BRIEF DESCRIPTION OF THE DRAWINGS

FIG. 16 is a diagram schematically showing the storage tank of the tank device of the flush toilet according to the first embodiment of the present invention, where the storage tank is in a tilted state, and the diagram chronologically shows, in (B-1), (B-2), and (B-3), a rise in a water level and a state of air lock in the storage tank during supply of flush water;

DETAILED DESCRIPTION OF THE PREFERRED EMBODIMENTS

Figure 1:
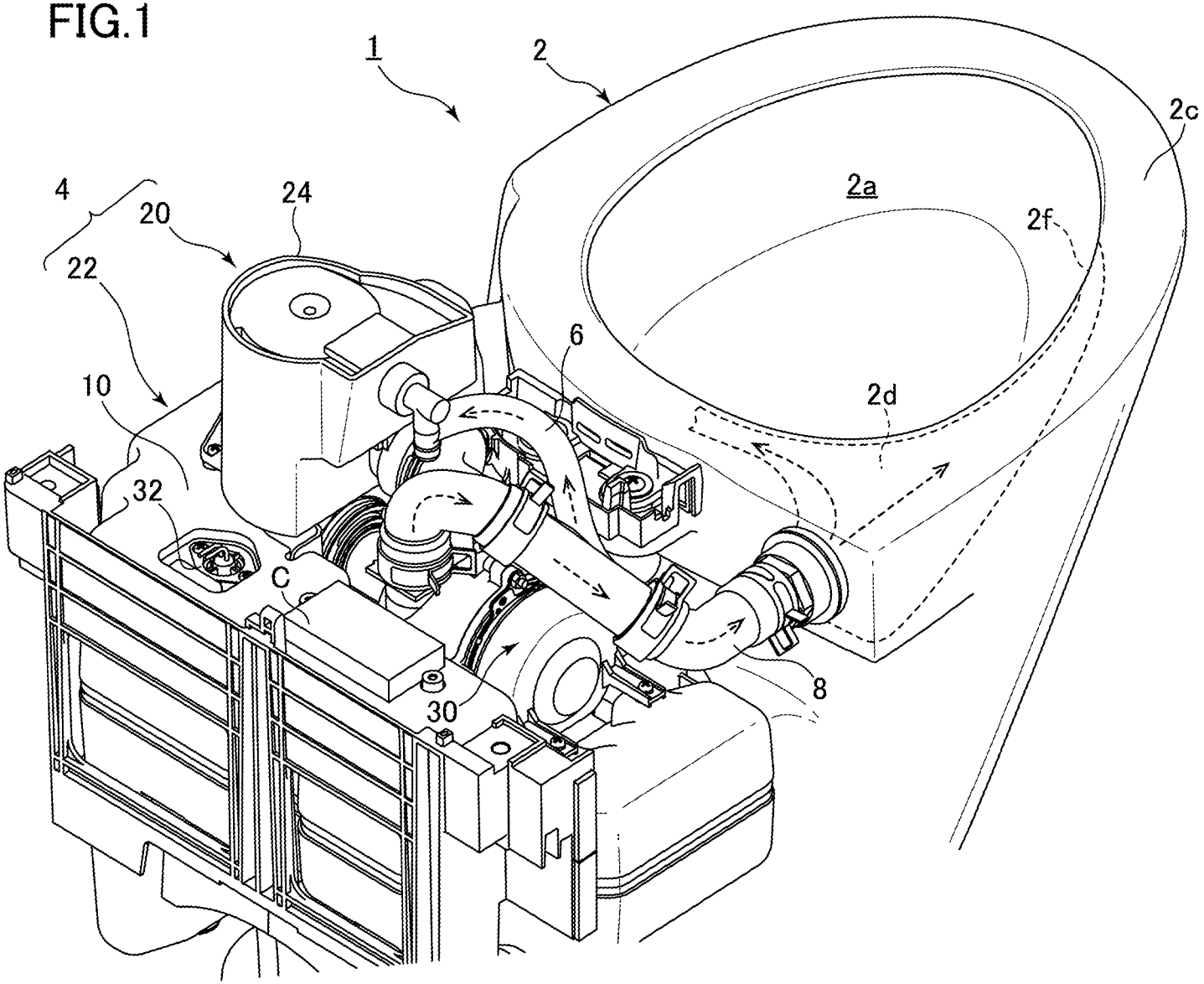
FIG. 1 is a schematic perspective view showing a flush toilet according to a first embodiment of the present invention, where the flush toilet is seen obliquely from behind and above.
Figure 2:
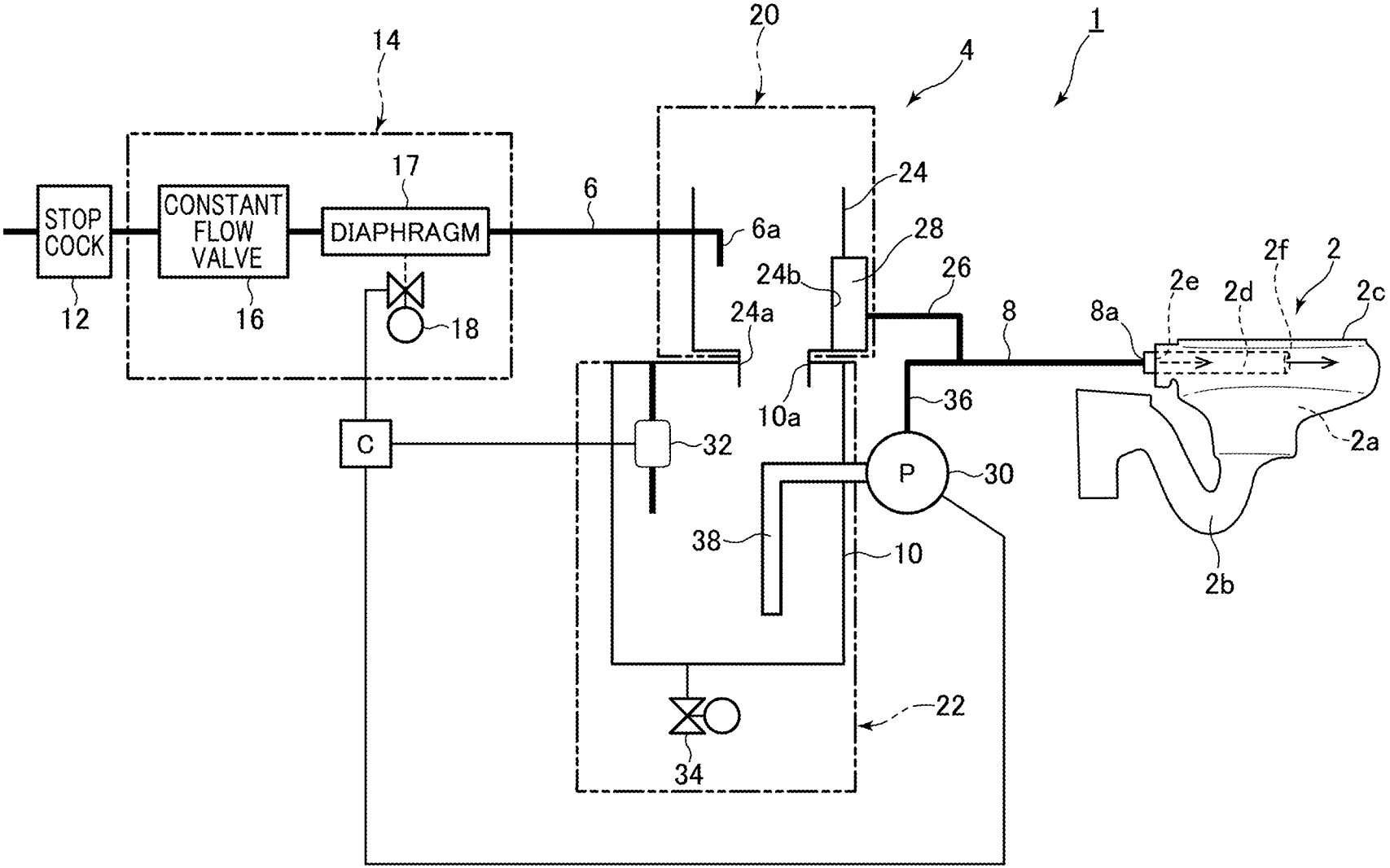
FIG. 2 is an overall configuration diagram of the flush toilet according to the first embodiment of the present invention.

Hereinafter, a flush toilet according to a first embodiment of the present invention will be described with reference to the appended drawings. First, FIG. 1 is a schematic perspective view showing the flush toilet according to the first embodiment of the present invention, where the flush toilet is seen obliquely from behind and above. Furthermore, FIG. 2 is an overall configuration diagram of the flush toilet according to the first embodiment of the present invention. As shown in FIGS. 1 and 2, a flush toilet 1 according to the first embodiment of the present invention includes a toilet main body 2 made of ceramics, and a tank device 4 that is provided behind the toilet main body 2. Furthermore, the toilet main body 2 includes a bowl 2*a* for receiving waste, a discharge trap (a discharge trap pipe 2*b*) for discharging waste in the bowl 2*a*, the discharge trap extending from a bottom portion of the bowl 2*a*, and a rim 2*c* formed at a top edge of the bowl 2*a*.

Next, as shown in FIGS. 1 and 2, the tank device 4 includes a water supply pipe 6 and a water discharge pipe 8 that are connected, respectively, on an upstream side and a downstream side of the tank device 4. An upstream side of the water supply pipe 6 is connected to an external water supply source (not shown) such as a water system. A downstream side of the water supply pipe 6 is connected to a storage tank 10 (of which more later) of the tank device 4. Flush water is thus supplied from the water supply pipe 6 to the storage tank 10. Furthermore, a stop cock 12 and a valve unit 14 are provided on the water supply pipe 6, from the upstream side to the downstream side. Moreover, the valve unit 14 includes a fixed flow valve 16 provided on the water supply pipe 6, and an electromagnetic valve 18 for opening/closing an on-off valve (a diaphragm valve 17) provided downstream of the fixed flow valve 16.

Next, as shown in FIGS. 1 and 2, the tank device 4 further includes a connecting unit 20 that is connected downstream of the valve unit 14 of the water supply pipe 6, and a tank unit 22 connected on a downstream side of the connecting unit 20 and including the storage tank 10. At the valve unit 14, a flow rate of flush water in the water supply pipe 6 is adjusted to be constant by the fixed flow valve 16. Then, when the electromagnetic valve 18 is electromagnetically opened, and a flow path in the water supply pipe 6 is released by the on-off valve (the diaphragm valve 17), the flush water in the water supply pipe 6 is supplied to the tank unit 22 through the connecting unit 20.

As shown in FIG. 2, the connecting unit 20 includes a water receiving housing 24, an overflow pipe 26, and a check valve 28. Moreover, the water receiving housing 24 is a connection element, a lower opening 24*a* of which is detachably connected to an upper opening (a water passage port 10*a*) of the storage tank 10 of the tank unit 22.

The overflow pipe 26 connects an overflow port 24*b* provided in a part of a side wall of the water receiving housing 24 and the water discharge pipe 8. An upstream side of the water discharge pipe 8 is a connection pipe (a flush water supply pipe) that is connected to a pump 30 of the tank device 4, and a downstream side of the water discharge pipe 8 is connected to a rim conduit 2*d* inside the rim 2*c* of the toilet main body 2. Moreover, the check valve 28 is provided at the overflow port 24*b*, and is capable of allowing flush water in the water receiving housing 24 to flow into the overflow pipe 26 from the overflow port 24*b* while preventing flush water in the overflow pipe 26 from flowing backward into the water receiving housing 24.

Next, as shown in FIG. 2, the tank unit 22 includes the storage tank 10, the pump 30, a float switch 32, a drain plug 34, a controller C, and the like. The pump 30 is provided at a part of (midway along) a water passage pipe 36 that is connected to the upstream side of the water discharge pipe 8. An upstream end 36*a* of the water passage pipe 36 is connected to a downstream end 38*a* of a suction pipe 38 provided inside the storage tank 10.

Flush water stored in the storage tank 10 is suctioned from the suction pipe 38 into the water passage pipe 36 by operation of the pump 30, and is then fed under pressure to the water discharge pipe 8 via the pump 30. All the flush water that is supplied from the storage tank 10 to the water discharge pipe 8 by the pump 30 is thus supplied into the rim conduit 2*d* from an inlet 2*e* of the rim conduit 2*d*. Then, the flush water in the rim conduit 2*d* is discharged into the bowl 2*a* from a rim spouting port 2*f* on a downstream end of the rim conduit 2*d*, and toilet flushing (toilet flushing by so-called 100% rim spouting) is thus performed. That is, the water passage pipe 36 and the water discharge pipe 8 each function as a flush water supply pipe for supplying, to the toilet main body 2, flush water that is fed, under pressure, from the storage tank 10 by the pump 30.

The float switch 32 detects a water level inside the storage tank 10. An opening/closing operation of the electromagnetic valve 18 of the valve unit 14 is controlled by the controller C based on the water level inside the storage tank 10 that is detected by the float switch 32. Furthermore, the operation of the pump 30 is also controlled by the controller C based on the water level inside the storage tank 10 that is detected by the float switch 32. For example, in the case where the water level inside the storage tank 10 that is detected by the float switch 32 is at or below a predetermined water level, the electromagnetic valve 18 is opened, the water supply pipe 6 is released, and the pump 30 is caused to operate. Then, when the water level inside the storage tank 10 reaches the predetermined water level, the electromagnetic valve 18 is closed, the water supply pipe 6 is closed, and the pump 30 is stopped.

The drain plug 34 is provided in a bottom surface of the storage tank 10. In normal use, the drain plug 34 is closed at all times, and the drain plug 34 can be removed as necessary to discharge the flush water in the storage tank 10 to outside.

Figure 3:
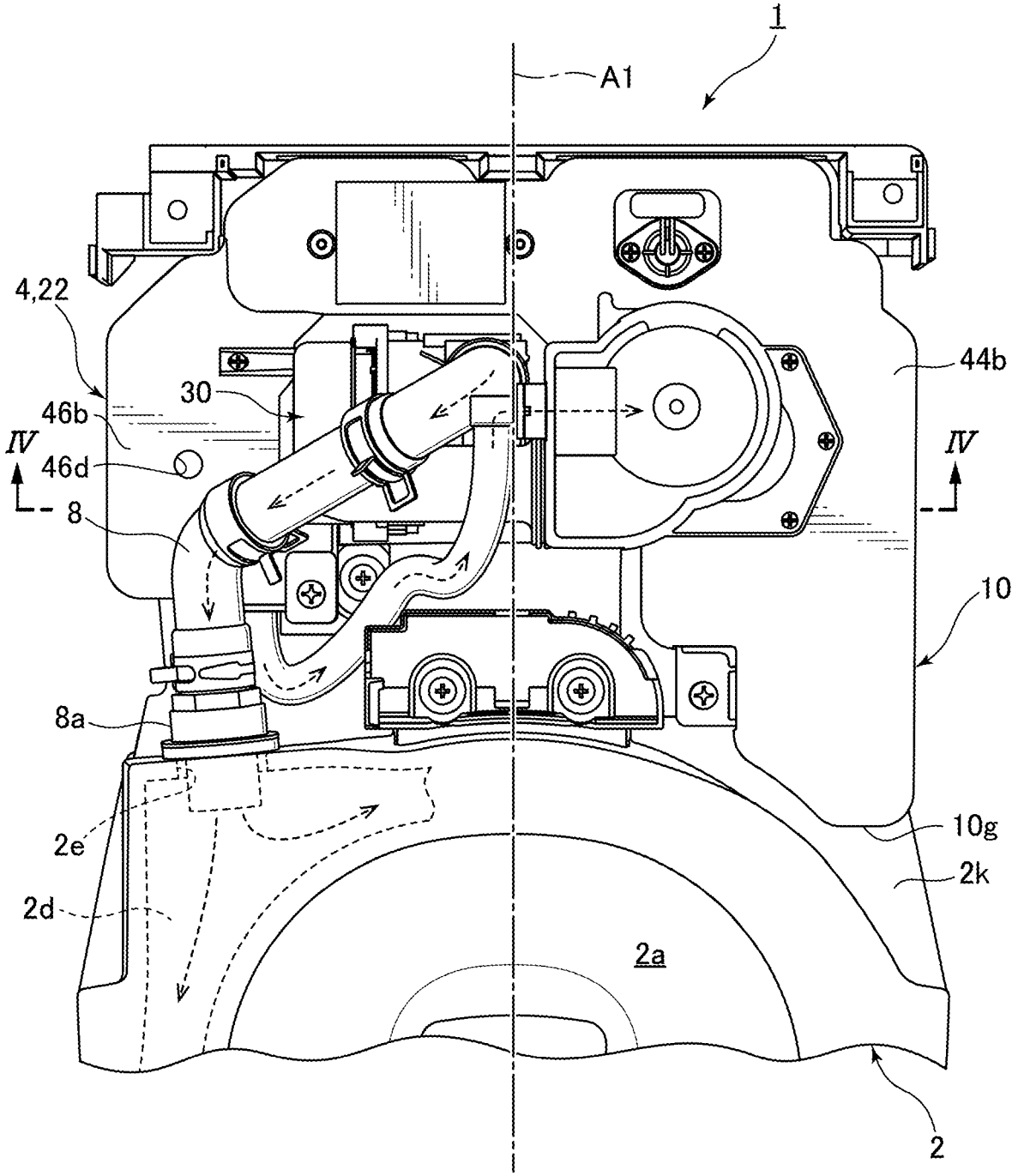
FIG. 3 is an enlarged partial plan view showing a part of the flush toilet according to the first embodiment of the present invention in an enlarged manner, the part corresponding to a tank unit.
Figure 4:
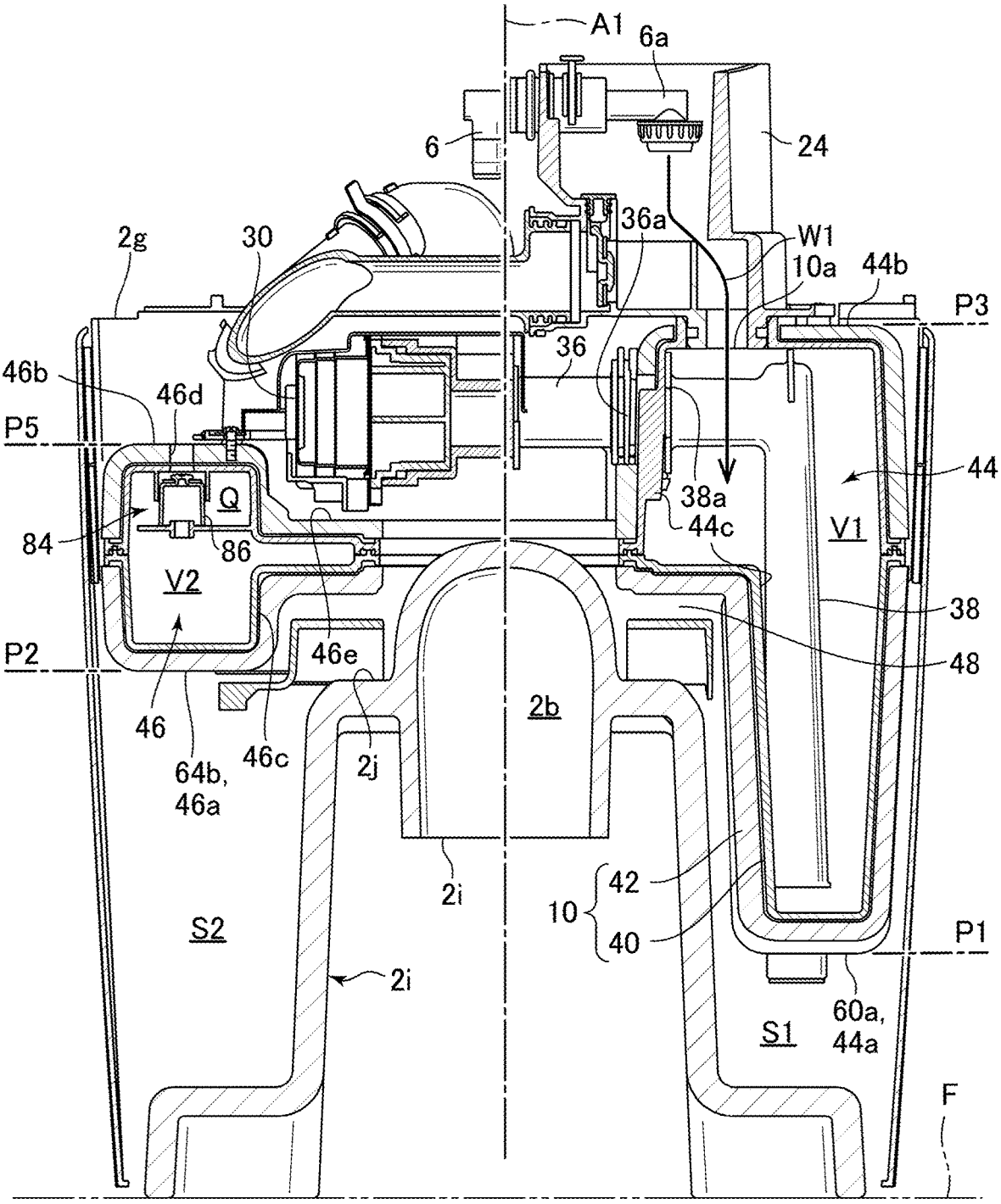
FIG. 4 is a cross-sectional view taken along a line IV-IV in FIG. 3.
Figure 5:
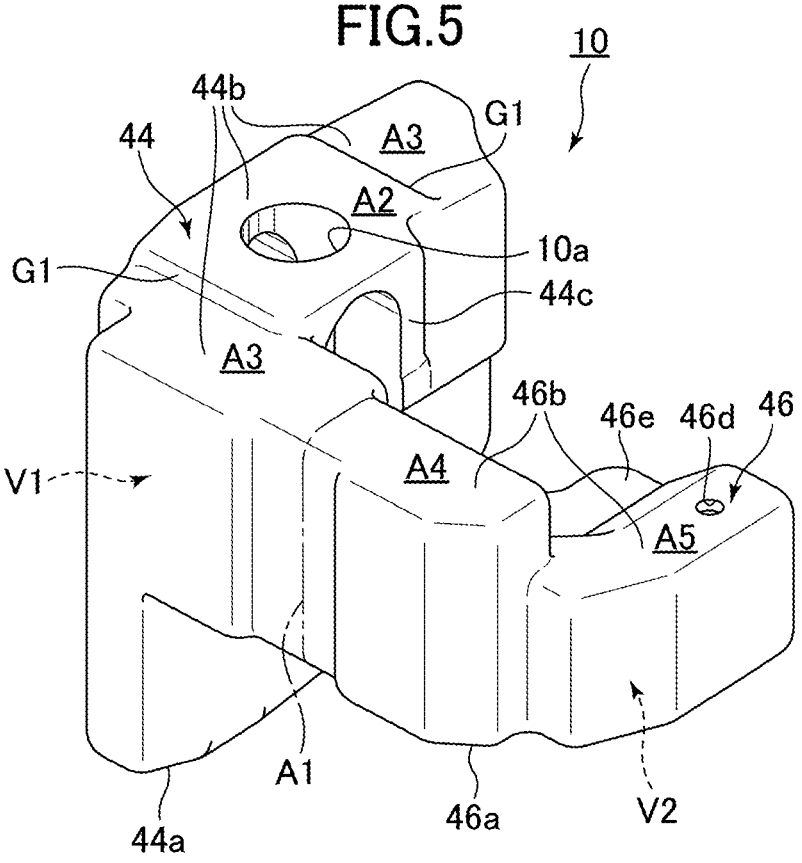
FIG. 5 is a perspective view showing a storage tank of the flush toilet according to the first embodiment of the present invention, where the storage tank is seen obliquely from behind and above.
Figure 6:
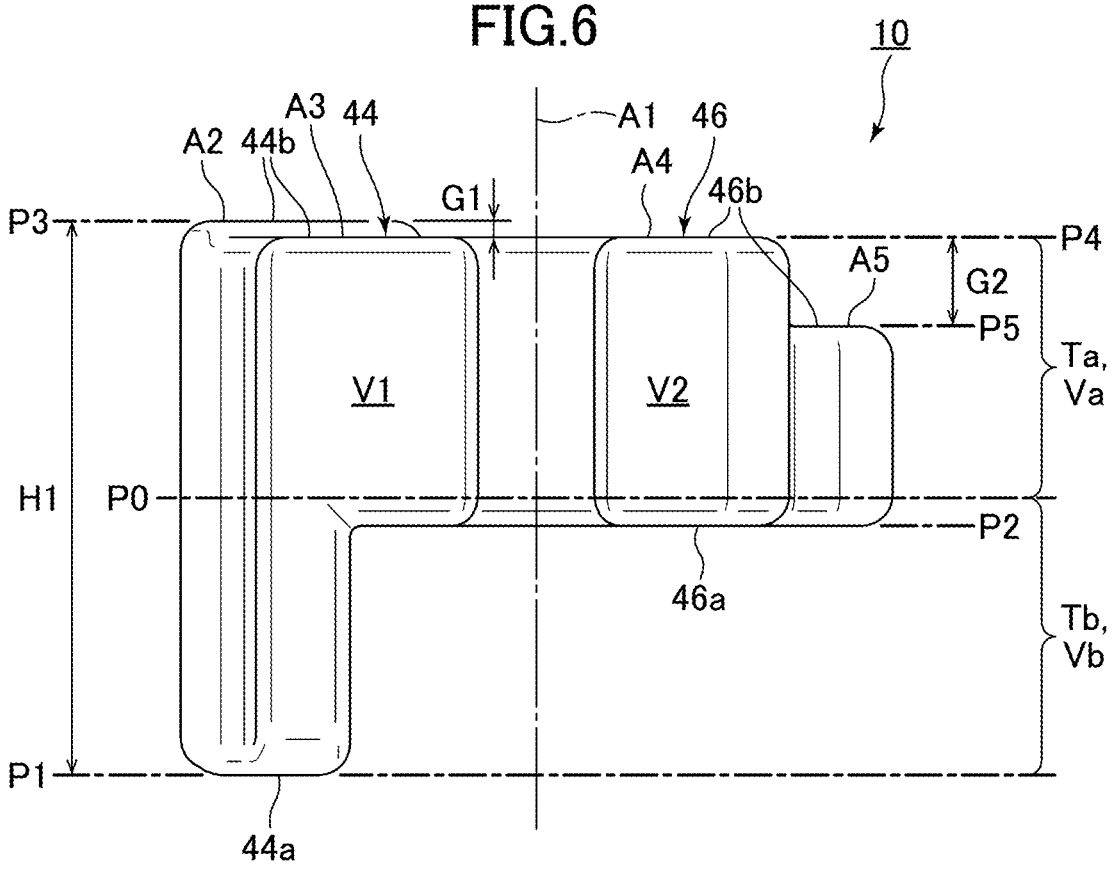
FIG. 6 is a rear view of the storage tank of the flush toilet according to the first embodiment of the present invention.

Next, details of the storage tank 10 of the tank unit 22 will be given with reference to FIGS. 3 to 6. FIG. 3 is an enlarged partial plan view showing a part of the flush toilet according to the first embodiment of the present invention in an enlarged manner, the part corresponding to the tank unit. FIG. 4 is a cross-sectional view taken along a line IV-IV in FIG. 3. First, as shown in FIGS. 3 and 4, the storage tank 10 of the tank unit 22 includes a single tank main body 40, and an antisweat material 42 covering an outside of the tank main body 40. Next, FIG. 5 is a perspective view showing the storage tank of the flush toilet according to the first embodiment of the present invention, where the storage tank is seen obliquely from behind and above. Furthermore, FIG. 6 is a rear view of the storage tank of the flush toilet according to the first embodiment of the present invention. As shown in FIGS. 3 to 6, when a virtual vertical plane that divides the storage tank 10 of the tank unit 22 into two at a center in a left-right direction is taken as "vertical plane A1", the single tank main body 40 of the storage tank 10 and the antisweat material 42 on the outside include a large tank section 44 and a small tank section 46 on left and right of the vertical plane A1, and are divided into two in the left-right direction by the vertical plane A1, into the large tank section 44 and the small tank section 46. That is, as shown in FIG. 6, when the tank main body 40 and the antisweat material 42 are seen from a rear surface side, the large tank section 44 is disposed on a left side of the vertical plane A1, and when the tank main body 40 and the antisweat material 42 are seen from the rear surface side, the small tank section 46 are disposed on a right side of the vertical plane A1, and a capacity V1 of the large tank section 44 is set greater than a capacity V2 of the small tank section 46 (V1>V2). Accordingly, because of the large tank section 44 and the small tank section 46, the storage tank 10 has an asymmetrical shape in the left-right direction (a deformed shape of an approximately C-shape or U-shape in a plan view).

Next, as shown in FIG. 4, the toilet main body 2 includes, in a region behind the bowl 2*a*, a large-tank housing section S1 and a small-tank housing section S1 for housing the large tank section 44 and the small tank section 46, respectively, at a position higher than a floor surface. That is, in the region behind the bowl 2*a* of the toilet main body 2, the large-tank housing section S1 is formed on one of left and right sides of the vertical plane A1 that divides the region into two in the left-right direction (on the right side of the vertical plane A1 when the toilet main body 2 is seen from front). In the region behind the bowl 2*a* of the toilet main body 2, the small-tank housing section S2 is formed on the other one of the left and right sides of the vertical plane A1 (on the left side of the vertical plane A1 when the toilet main body 2 is seen from the front).

Furthermore, as shown in FIGS. 4 to 6, in a state where the large tank section 44 and the small tank section 46 are disposed in the large-tank housing section S1 and the small-tank housing section S2, respectively, a lowest position P1 of a bottom surface 44*a* of the large tank section 44 is located below a lowest position P2 of a bottom surface 46*a* of the small tank section 46. Furthermore, as shown in FIGS. 4 to 6, in the state where the large tank section 44 and the small tank section 46 are disposed in the large-tank housing section S1 and the small-tank housing section S2, respectively, a position P3 (a highest position P3) of a first upper surface (an upper surface 44*b*) of the large tank section 44 is positioned higher than a position P4 of a second upper surface (an upper surface 46*b*) of the small tank section 46 and lower than an upper surface 2*g* of the rim 2*c* of the toilet main body 2. Additionally, a tank mounting member 48, of which more later, is fixed behind the toilet main body 2, and the storage tank 10 may be attached to the tank mounting member 48 from above. That is, the storage tank 10 is indirectly attached to the toilet main body 2 via the tank mounting member 48. Additionally, the storage tank 10 may alternatively be directly attached to the toilet main body 2, without providing the tank mounting member 48.

Next, as shown in FIG. 6, a capacity Va of an upper part Ta of the storage tank 10 that is located at a position higher than a middle height position (a middle height position P0 in an up-down direction) that equally divides a distance (a vertical-direction distance H1) between the lowest position P1 and the highest position P3 of the large tank section 44 of the storage tank 10 in the up-down direction into two is set greater than a capacity Vb of a lower part Vb of the storage tank 10 that is located at a position lower than the middle height position P0 (Va>Vb). Furthermore, as shown in FIGS. 4 to 6, the upper surface 44*b* of the large tank section 44 of the storage tank 10 and the upper surface 46*b* of the small tank section 46 each include a height difference. Particularly, the water passage port 10*a* is provided in a highest surface A2 of the upper surface 44*b* of the large tank section 44 of the storage tank 10 in a manner penetrating the highest surface A2 in a vertical direction. Thanks to the water passage port 10*a*, flush water W1 supplied to the water receiving housing 24 from a water supply nozzle 6*a* (see FIGS. 2 and 4) that is a water supply device connected to a downstream end of the water supply pipe 6 flows into the storage tank 10 to be stored. Additionally, the present embodiment describes a mode where, in relation to the storage tank 10, the upper surfaces of the large tank section 44 and the small tank section 46 with a height difference to each other are flat surfaces, but such a mode is not restrictive, and a mode is also possible where the highest surface of the storage tank 10 is a flat surface and a height difference is generated by including a surface that slopes downward from the highest surface, for example.

Furthermore, as shown in FIGS. 5 and 6, the upper surface 44*b* of the large tank section 44 of the storage tank 10 is formed such that the upper surface 44*b* becomes lower in a continuous or stepwise manner across a small step G1, from the surface A2 where the water passage port 10*a* is formed toward a surface A3 on an outer periphery of the surface A2. Additionally, the upper surface 44*b* of the large tank section 44 of the storage tank 10 may be formed as a tapered shape, with the upper surface 44*b* sloping downward in a continuous manner from the surface A2 where the water passage port 10*a* is formed toward the surface A3 on the outer periphery of the surface A2, or the upper surface 44*b* may be formed such that the upper surface 44*b* becomes lower in a stepwise manner with a step larger than the small step G1 mentioned above. Moreover, in relation to the upper surface 46*b* of the small tank section 46 of the storage tank 10, a surface A4 extends in a horizontal left-right direction at a same height as the upper surface A3 of the large tank section 44, and a flat surface A5 is formed at a lower position P5 across a step G2.

As shown in FIGS. 2 and 4, the suction pipe 38 is provided inside the large tank section 44 of the tank main body 40, and the upstream end 36*a* of the water passage pipe 36 extending on an upstream side (sideways) from the pump 30 is connected to the downstream end 38*a* of the suction pipe 38, that is a part of the large tank section 44, in a watertight manner. Furthermore, as shown in FIG. 3, an upstream end of the water discharge pipe 8 is connected to a downstream end of the water passage pipe 36 extending on a downstream side (upward) from the pump 30, and a downstream end (an outlet 8*a*) of the water discharge pipe 8 is connected to the inlet 2*e* of the rim conduit 2*d* on the other one of the left and right sides of the vertical face A1 of the toilet main body 2 (on the left side of the vertical face A1 when the toilet main body 2 is seen from the front).

Next, as shown in FIG. 4, a side wall surface 44*c* of the large tank section 44, on the side of the vertical plane A1 (at the center in the left-right direction), is positioned inside the large-tank housing section S1 and outward of the discharge trap pipe 2*b* (on the right side when the discharge trap pipe 2*b* is seen from the front). Likewise, a side wall surface 46*c* of the small tank section 46, on the side of the vertical plane A1 (at the center in the left-right direction), is positioned inside the small-tank housing section S2 and outward of the discharge trap pipe 2*b* (on the left side when the discharge trap pipe 2*b* is seen from the front). Furthermore, as shown in FIGS. 4 and 5, the discharge trap pipe 2*b* is provided at the center of the toilet main body 2 in the left-right direction, and the upstream end 36*a* of the water passage pipe 36 is connected to the side wall surface 44*c*, of the left and right side surfaces of the large tank section 44, on the discharge trap pipe 2*b* side.

Furthermore, as shown in FIGS. 3 and 4, the pump 30 is disposed behind the bowl 2*a* of the toilet main body 2, at a position higher than the discharge trap pipe 2*b*. Furthermore, the pump 30 is disposed in a space between the large tank section 44 and the small tank section 46 in the left-right direction, and is provided more to the center of the toilet main body 2 in the left-right direction than the upstream end 36*a* of the water passage pipe 36 and the downstream end (the outlet 8*a*) of the water discharge pipe 8.

Figure 7:
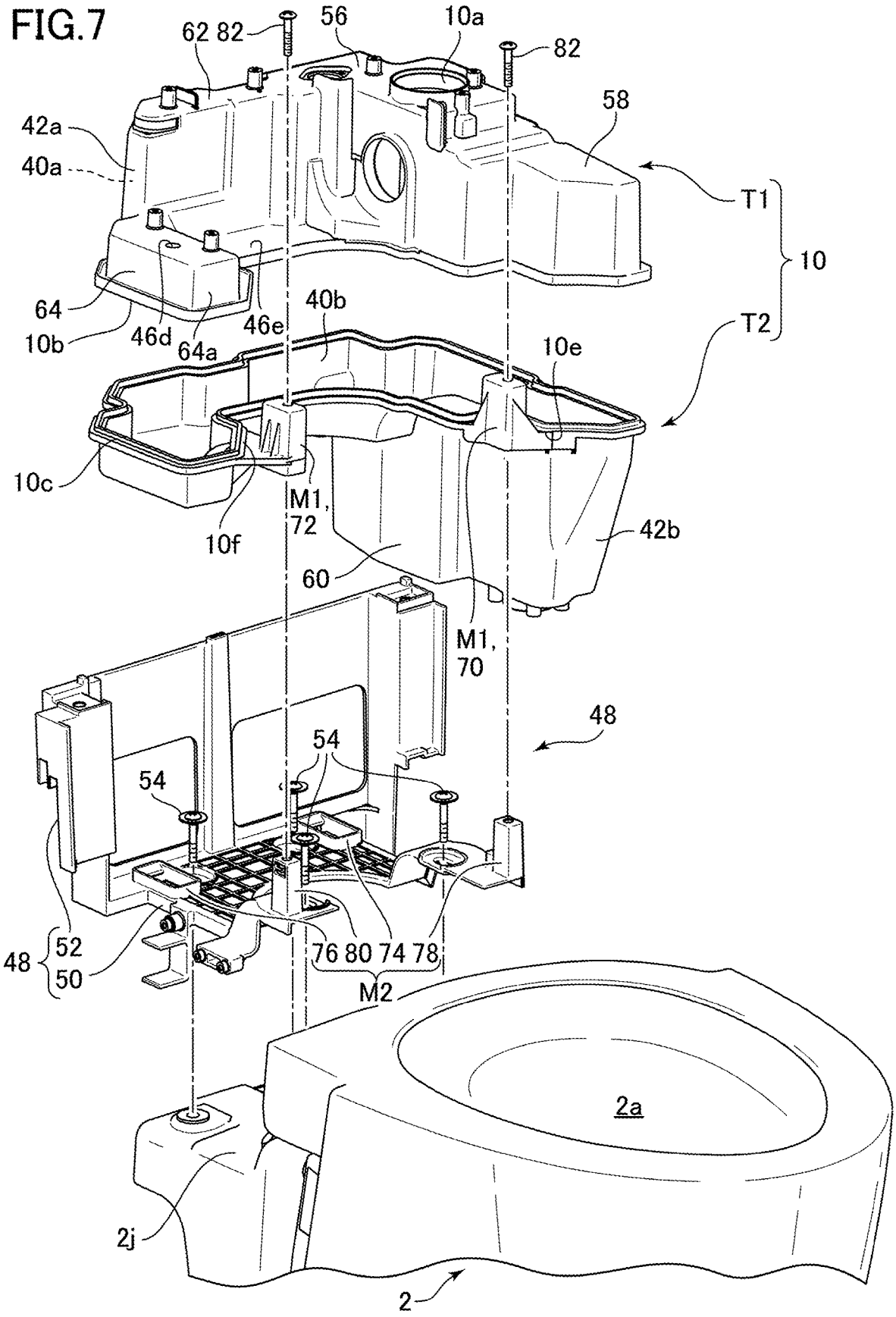
FIG. 7 is an exploded perspective view showing a toilet main body, a tank mounting member, and the storage tank of the flush toilet according to the first embodiment of the present invention.
Figure 8:
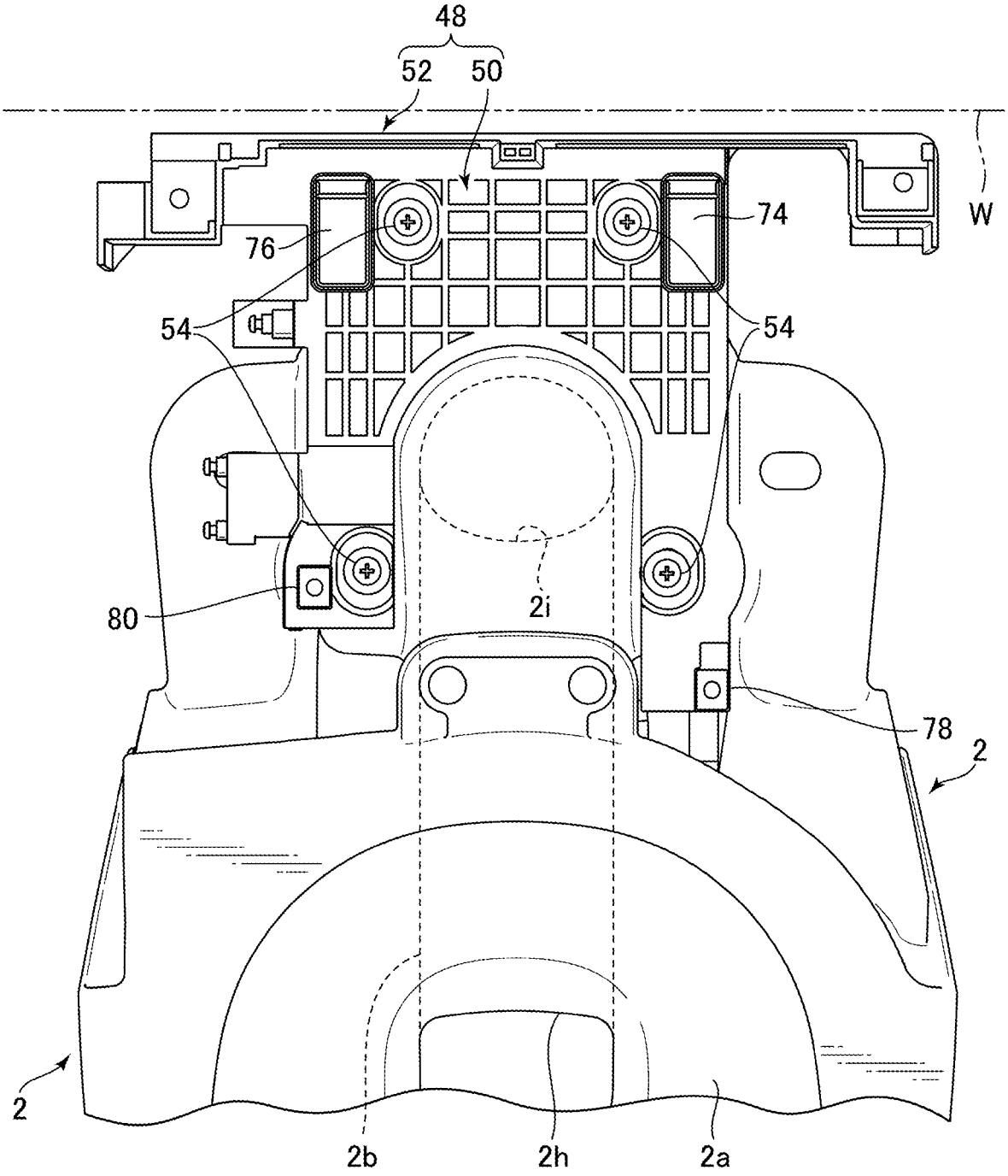
FIG. 8 is a plan view showing a state where the tank mounting member is attached to the toilet main body of the flush toilet according to the first embodiment of the present invention.

Next, a specific description will be given with reference to FIG. 4 and FIGS. 7 to 14, of the tank mounting member 48, mentioned above, that is fixed to the toilet main body 2, and of an attachment structure between a fixing portion (an attaching portion M1) of the storage tank 10 and an attachment-receiving portion M2 of the tank mounting member 48. First, FIG. 7 is an exploded perspective view showing the toilet main body, the tank mounting member, and the storage tank of the flush toilet according to the first embodiment of the present invention. Next, FIG. 8 is a plan view showing a state where the tank mounting member is attached to the toilet main body of the flush toilet according to the first embodiment of the present invention. Furthermore, FIG. 9 is a plan view showing a state where the storage tank is attached, via the tank mounting member, to the toilet main body of the flush toilet according to the first embodiment of the present invention.

Figure 9:
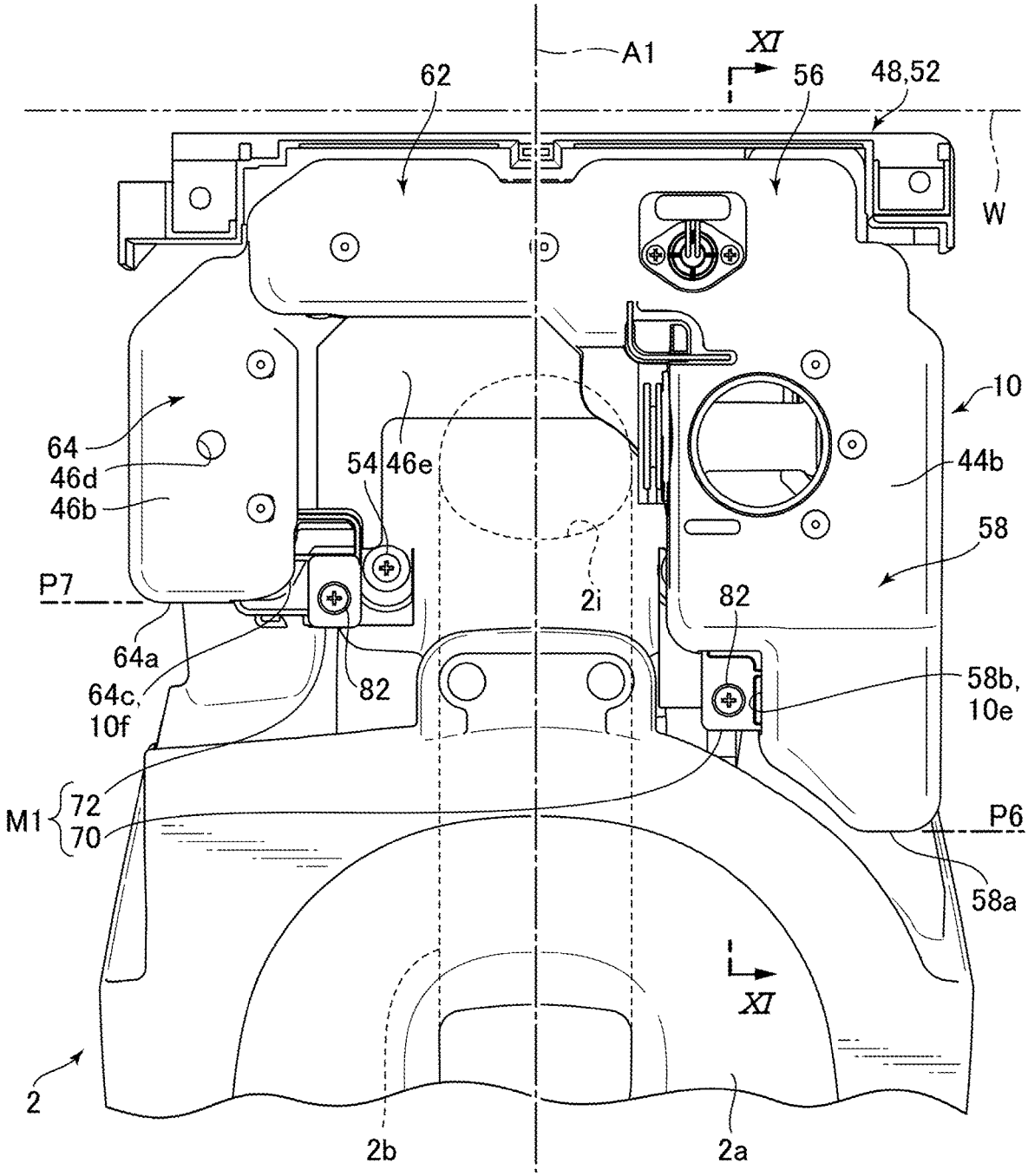
FIG. 9 is a plan view showing a state where the storage tank is attached, via the tank mounting member, to the toilet main body of the flush toilet according to the first embodiment of the present invention.

First, as shown in FIG. 4 and FIGS. 7 to 9, the tank mounting member 48 includes a base (a base plate 50) that is to be fixed behind the bowl 2*a* of the toilet main body 2, and a rear surface-side supporting plate 52 extending upward from a rear end of the base plate 50. Furthermore, in plan views in FIGS. 8 and 9, the discharge trap pipe 2*b* of the toilet main body 2 extends in a front-back direction from an inlet 2*h* of the discharge trap pipe 2*b* connected to a lower part of the bowl 2*a* of the toilet main body 2 to an outlet 2*i* behind the bowl 2*a*. Then, as shown in FIGS. 4, 7 and 8, a supporting surface 2*j* that is made of ceramics and to which the base plate 50 is to be fixed is formed at an upper part and on lateral sides of the discharge trap pipe 2*b* of the toilet main body 2, above the outlet 2*i* of the discharge trap pipe 2*b*. Accordingly, the base plate 50 is fixed from above with a plurality (four) of screws 54 while being supported by the supporting surface 2*j* behind the toilet main body 2 from below. Furthermore, as shown in FIGS. 8 and 9, in a state where the tank mounting member 48 is fixed to the toilet main body 2, the rear surface-side supporting plate 52 is disposed adjacent to an external wall surface W on a rear side.

Figure 10:
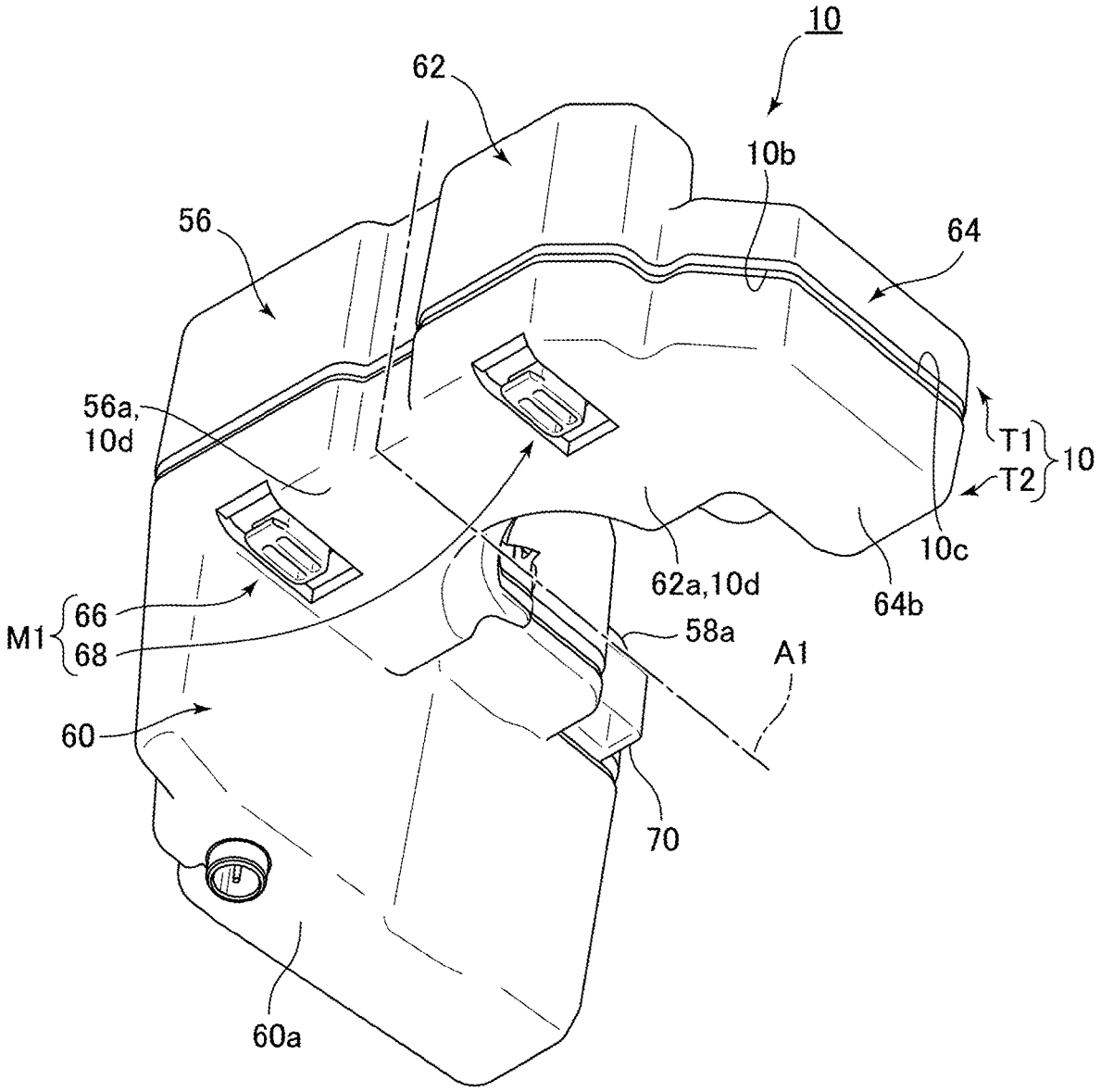
FIG. 10 is a perspective view of the storage tank of the flush toilet according to the first embodiment of the present invention, where the storage tank is seen obliquely from behind and below.
Figure 11:
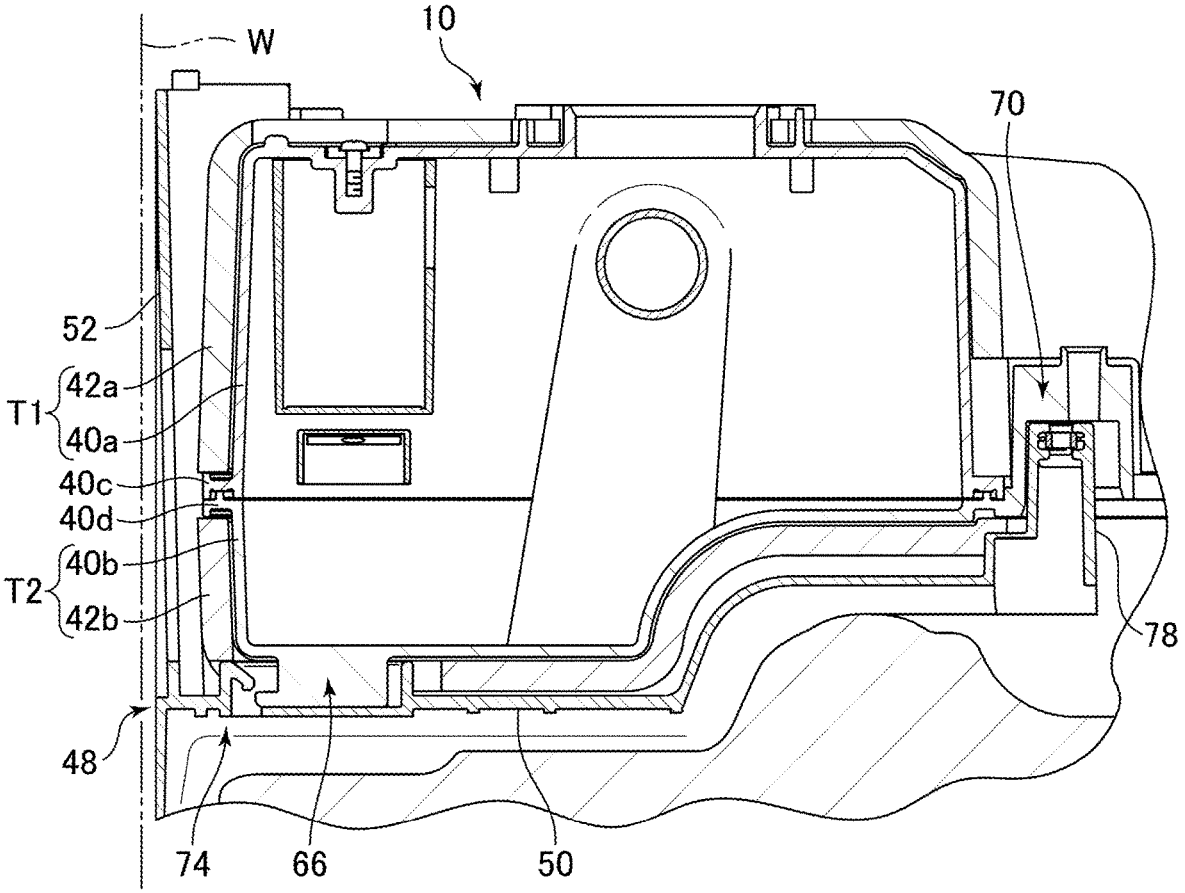
FIG. 11 is a cross-sectional view taken along a line XI-XI in FIG. 9, and is an enlarged partial cross-sectional view showing parts corresponding to the storage tank and the tank mounting member behind the toilet main body in an enlarged manner.

Next, FIG. 10 is a perspective view of the storage tank of the flush toilet according to the first embodiment of the present invention, where the storage tank is seen obliquely from behind and below. Furthermore, FIG. 11 is a cross-sectional view taken along a line XI-XI in FIG. 9, and is an enlarged partial cross-sectional view showing parts corresponding to the storage tank and the tank mounting member behind the toilet main body in an enlarged manner. First, as shown in FIGS. 7, 10 and 11, the storage tank 10 includes a top tank section (a top tank member T1) and a bottom tank section (a bottom tank member T2) that are joined to each other in the up-down direction. Furthermore, the top tank member T1 includes an upper tank main body 40*a* and an upper antisweat material 42*a* on an outside of the upper tank main body 40*a*, and the bottom tank member T2 includes a lower tank main body 40*b* and a lower antisweat material 42*b* on an outside of the lower tank main body 40*b*. That is, in a state where a lower-edge joining portion 10*b* of the top tank member T1 of the storage tank 10 and an upper-edge joining portion 10*c* of the bottom tank member T2 are joined together, a lower-edge joining portion 40*c* of the upper tank main body 40*a* of the top tank member T1 and an upper-edge joining portion 40*d* of the lower tank main body 40*b* of the bottom tank member T2 are joined together in a watertight manner to form a single tank main body 40. Moreover, the tank main body 40 is covered on the outside with the upper antisweat material 42*a* and the lower antisweat material 42*b* from above and below.

Next, as shown in FIGS. 9 and 10, the large tank section 44 of the storage tank 10 includes a rear large tank section 56 disposed behind the discharge trap pipe 2*b*, a front large tank section 58 extending forward from the rear large tank section 56 while being disposed on the one of the left and right sides of the discharge trap pipe 2*b* (the right side when the toilet main body 2 is seen from the front), and a lower large tank section 60 extending downward from the rear large tank section 56. Next, as shown in FIGS. 9 and 10, the small tank section 46 of the storage tank 10 includes a rear small tank section 62 disposed behind the discharge trap pipe 2*b*, and a front small tank section 64 extending forward from the rear small tank section 62 while being disposed on the other one of the left and right sides of the discharge trap pipe 2*b* (the left side when the toilet main body 2 is seen from the front). Furthermore, as shown in FIGS. 9 and 10, a position P6 of a front end 58*a* of the front large tank section 58 is positioned more forward than a position P7 of a front end 64*a* of the front small tank section 64. Moreover, as shown in FIGS. 4 and 10, a bottom surface 60*a* of the lower large tank section 60 is located below a bottom surface 62*a* of the rear small tank section 62 and a bottom surface 64*b* of the front small tank section 64.

Figure 12:
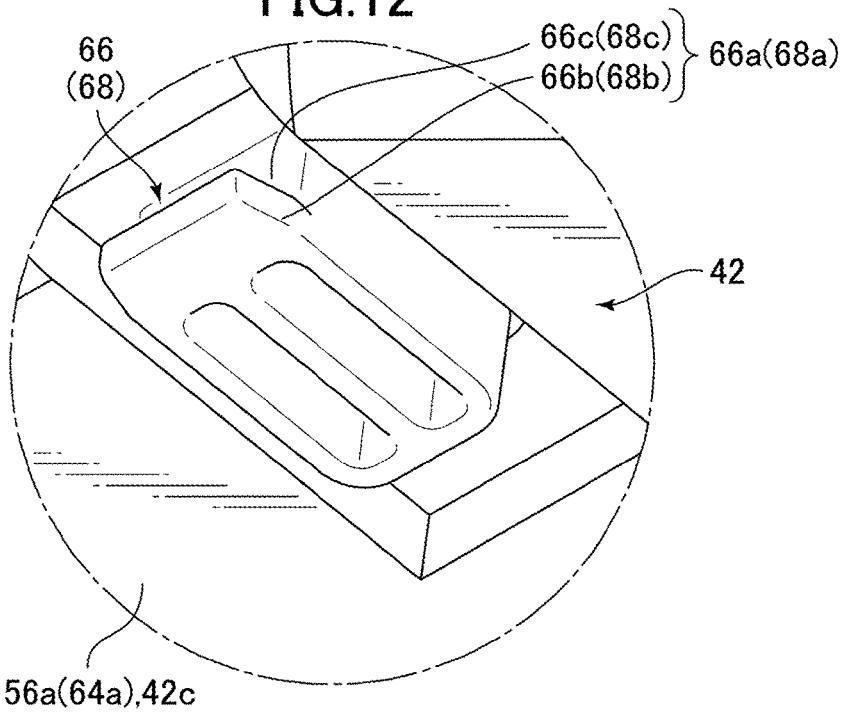
FIG. 12 is an enlarged partial view showing a part of the flush toilet according to the first embodiment of the present invention in an enlarged manner, the part corresponding to an attaching portion of the storage tank shown in FIG. 10.

Next, FIG. 12 is an enlarged partial view showing a part of the flush toilet according to the first embodiment of the present invention in an enlarged manner, the part corresponding to the attaching portion of the storage tank shown in FIG. 10. First, as shown in FIG. 7 and FIGS. 9 to 11, the fixing portions (the attaching portions M1) of the storage tank 10 include, on a bottom surface 56*a* of the rear large tank section 56 of the storage tank 10 and a bottom surface 62*a* of the rear small tank section 62 (that is, a bottom surface 10*d* on a rearward side of the bottom tank member T2 of the storage tank 10 shown in FIG. 10), a pair of left and right large tank-side attaching portion (a rear attaching portion 66) and small tank-side attaching portion (a rear attaching portion 68). Furthermore, as shown in FIG. 7 and FIGS. 9 to 11, the fixing portions (the attaching portions M1) of the storage tank 10 further include, on a part of an inner side surface 58*b* of the front large tank section 58 of the storage tank 10 and a part of an inner side surface 64*c* of the front small tank section 64 (that is, on inner side surfaces 10*e*, 10*f* of the bottom tank member T2 of the storage tank 10 shown in FIGS. 7 and 9), a left and right pair of large tank-side attaching portion (a front attaching portion 70) and small tank-side attaching portion (a front attaching portion 72). That is, as the fixing portion of the storage tank 10 for fixing the storage tank 10 to the toilet main body 2 and the tank mounting member 48, a plurality of (four) attaching portions M1 (66, 68, 70, 72) are provided only on the bottom tank member T2 side, and no fixing portion is provided on the top tank member T1 side. Additionally, the present embodiment describes a mode where a plurality of (four) fixing portions of the storage tank 10 are provided only on the bottom tank member T2, but the plurality of fixing portions are not limited to four. Alternatively, the fixing portion of the storage tank 10 may be provided on each of the top tank member T1 and the bottom tank member T2. In this case, the number of fixing portions of the storage tank 10 is desirably greater for the bottom tank member T2 than for the top tank member T1.

As shown in FIGS. 7, 8 and 11, the attachment-receiving portion M2 of the tank mounting member 48 includes a pair of left and right rear attachment-receiving portions 74, 76 that are provided on a rear side on the base plate 50 of the tank mounting member 48. The rear attaching portions 66, 68 of the storage tank 10 can be attached to the corresponding attachment-receiving portions 74, 76 from above. Furthermore, as shown in FIGS. 7, 8 and 11, the attachment-receiving portion M2 of the tank mounting member 48 further includes a pair of left and right front attachment-receiving portions 78, 80 that are provided on a front side of the base plate 50 of the tank mounting member 48. The front attaching portions 70, 72 of the storage tank 10 can be attached to the corresponding attachment-receiving portions 78, 80 from above. Additionally, the attaching portions 66, 70 of the storage tank 10 and the attachment-receiving portions 74, 78 of the tank mounting member 48 shown in FIG. 11 are in a state where the attaching portions 66, 70 of the storage tank are attached and engaged with the corresponding attachment-receiving portions 74, 78 of the tank mounting member 48 from above but are not yet fixed to each other.

Figure 13A:
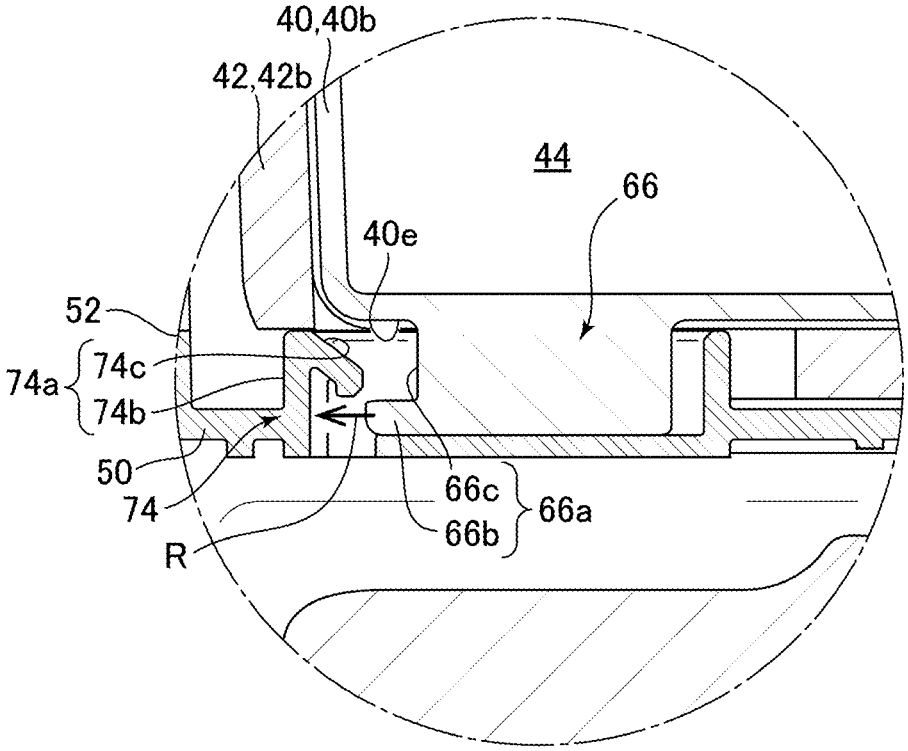
FIG. 13A is an enlarged partial cross-sectional view showing a part of the flush toilet according to the first embodiment of the present invention shown in FIG. 11 in an enlarged manner, the part corresponding to a large-tank rear attaching portion of the storage tank and a rear attachment-receiving portion of the tank mounting member, FIG. 13A showing a state before the large-tank rear attaching portion of the storage tank is moved rearward after being engaged with the rear attachment-receiving portion of the tank mounting member from above (a pre-positioning state)
Figure 13B:
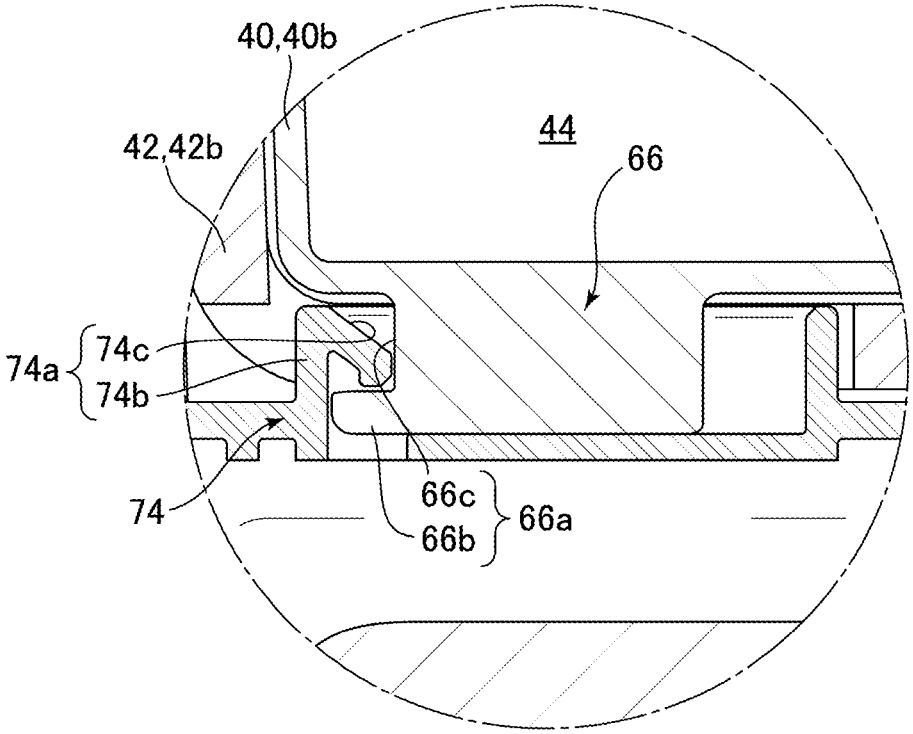
FIG. 13B is, like FIG. 13A, an enlarged partial cross-sectional view showing a part of the flush toilet according to the first embodiment of the present invention in an enlarged manner, the part corresponding to the large-tank rear attaching portion of the storage tank and the rear attachment-receiving portion of the tank mounting member, FIG. 13B showing a state where the large-tank rear attaching portion of the storage tank is moved rearward after being engaged with the rear attachment-receiving portion of the tank mounting member from above and positioning is completed (a positioning completion state)
Figure 13C:
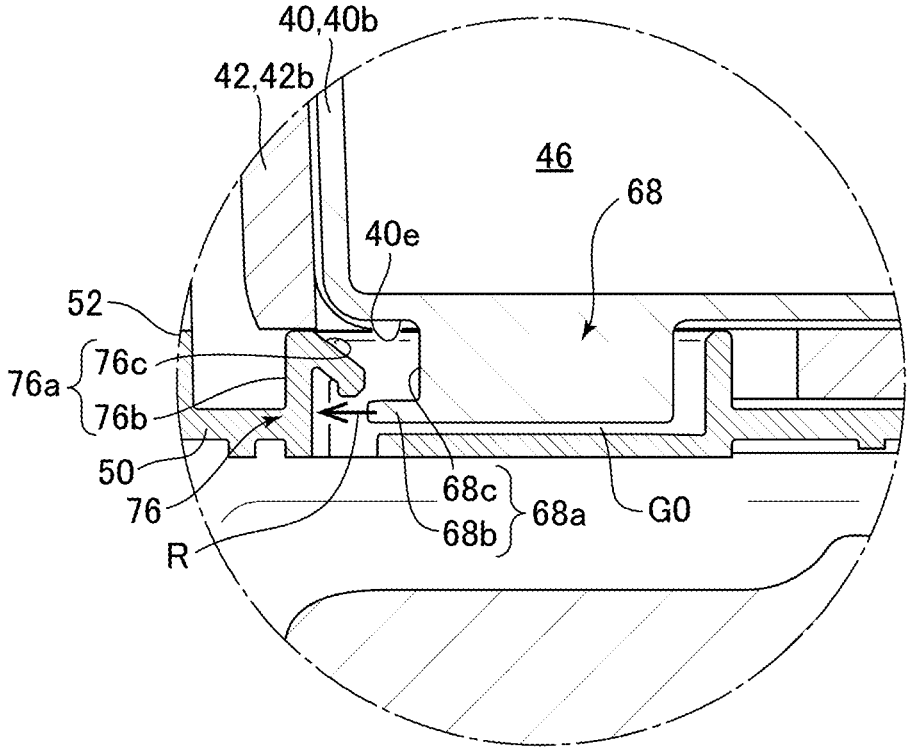
FIG. 13C is, like FIG. 13A, an enlarged partial cross-sectional view showing a part of the flush toilet according to the first embodiment of the present invention in an enlarged manner, the part corresponding to a small-tank rear attaching portion of the storage tank and a rear attachment-receiving portion of the tank mounting member, FIG. 13C showing a state before the small-tank rear attaching portion of the storage tank is moved rearward after being engaged with the rear attachment-receiving portion of the tank mounting member from above (a pre-positioning state)
Figure 13D:
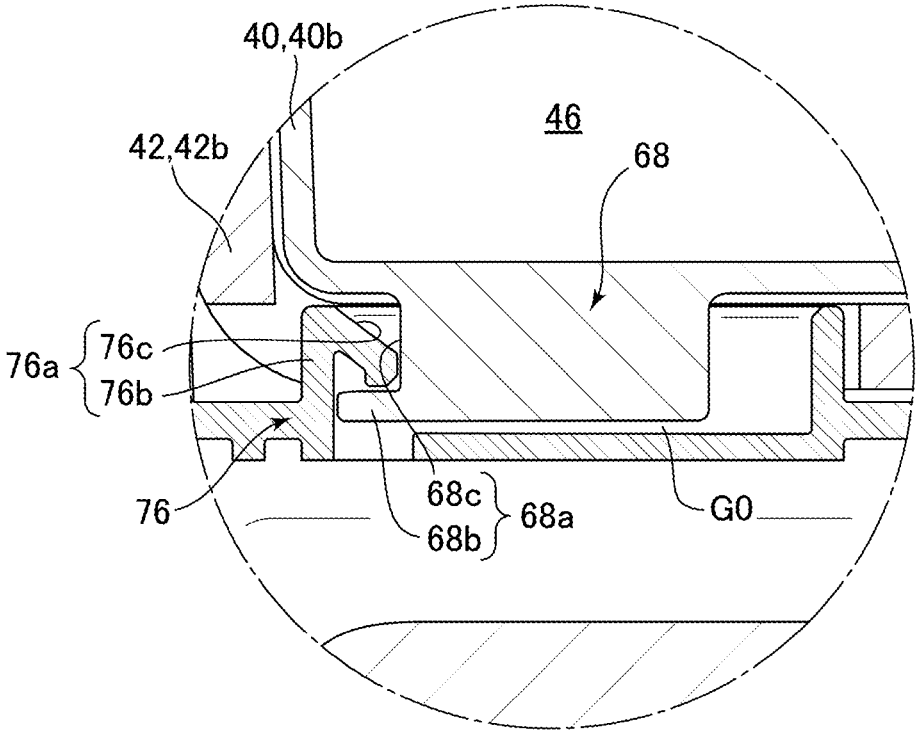
FIG. 13D is, like FIG. 13C, an enlarged partial cross-sectional view showing a part of the flush toilet according to the first embodiment of the present invention in an enlarged manner, the part corresponding to the small-tank rear attaching portion of the storage tank and the rear attachment-receiving portion of the tank mounting member, FIG. 13D showing a state where the small-tank rear attaching portion of the storage tank is moved rearward after being engaged with the rear attachment-receiving portion of the tank mounting member from above and positioning is completed (a positioning completion state)

Next, FIG. 12 is an enlarged partial view showing a part of the flush toilet according to the first embodiment of the present invention in an enlarged manner, the part corresponding to the attaching portion of the storage tank shown in FIG. 10. Furthermore, FIG. 13A is an enlarged partial cross-sectional view showing a part of the flush toilet according to the first embodiment of the present invention shown in FIG. 11 in an enlarged manner, the part corresponding to the large-tank rear attaching portion of the storage tank and the rear attachment-receiving portion of the tank mounting member, FIG. 13A showing a state before the large-tank rear attaching portion of the storage tank is moved rearward after being engaged with the rear attachment-receiving portion of the tank mounting member from above (a pre-positioning state). FIG. 13B is, like FIG. 13A, an enlarged partial cross-sectional view, and shows a state where the large-tank rear attaching portion of the storage tank is moved rearward after being engaged with the rear attachment-receiving portion of the tank mounting member from above and positioning is completed (a positioning completion state). Next, FIG. 13C is, like FIG. 13A, an enlarged partial cross-sectional view showing a part of the flush toilet according to the first embodiment of the present invention in an enlarged manner, the part corresponding to the small-tank rear attaching portion of the storage tank and the rear attachment-receiving portion of the tank mounting member, FIG. 13C showing a state before the small-tank rear attaching portion of the storage tank is moved rearward after being engaged with the rear attachment-receiving portion of the tank mounting member from above (a pre-positioning state). FIG. 13D is, like FIG. 13C, an enlarged partial cross-sectional view showing a part of the flush toilet according to the first embodiment of the present invention in an enlarged manner, the part corresponding to the small-tank rear attaching portion of the storage tank and the rear attachment-receiving portion of the tank mounting member, FIG. 13D showing a state where the small-tank rear attaching portion of the storage tank is moved rearward after being engaged with the rear attachment-receiving portion of the tank mounting member from above and positioning is completed (a positioning completion state).

First, as shown in FIGS. 12, 13A, 13C and 14A, each rear attaching portion 66, 68 of the storage tank 10 protrudes downward from the bottom surface of the tank main body 40, and a lower end thereof is a foot portion that can come into contact with a bottom surface inside the corresponding rear attachment-receiving portion 74, 76 of the tank mounting member 48. Furthermore, the antisweat material 42 is cut out around each rear attaching portion 66, 68 of the storage tank 10, and the lower end of each rear attaching portion 66, 68 (a bottom surface of the foot portion) is at a position that is slightly lower than the bottom surface 56*a*, 62*a* of the storage tank 10 (a bottom surface 42*c* of the antisweat material 42). Furthermore, a locking portion (an attaching-side locking portion 66*a*, 68*a*) to be locked with the corresponding rear attachment-receiving portion 74, 76 of the tank mounting member 48 is provided at a lower end portion (the foot portion) of the corresponding rear attaching portion 66, 68. As shown in FIGS. 13A to 13D, each rear attachment-receiving portion 74, 76 of the tank mounting member 48 is formed into a concave shape so as to be able to wholly receive the corresponding rear attaching portion 66, 68 of the storage tank 10 from above, and a locking portion (an attachment receiving-side locking portion 74*a*, 76*a*) that can be locked together with the corresponding attaching-side locking portion 66*a*, 68*a* of the rear attaching portion 66, 68 of the storage tank 10 is provided on a rear side of the rear attachment-receiving portion 74, 76. Next, as shown in FIGS. 12, and 13A to 13D, each locking portion 66*a*, 68*a* of the storage tank 10 includes a locking projection 66*b*, 68*b* protruding rearward from a rear end of a bottom portion of the corresponding attaching portion 66, 68, and a locking concave portion 66*c*, 68*c* that is formed between the locking projection 66*b*, 68*b* and the bottom surface 40*e* of the tank main body 40 above. Furthermore, as shown in FIGS. 13A to 13D, each locking portion 74*a*, 76*a* of the tank mounting member 48 includes a locking projection 74*b*, 76*b* that protrudes upward from near a rear end of the base plate 50.

As shown in FIG. 13A, when the storage tank 10 is attached from above to the tank mounting member 48 fixed behind the toilet main body 2, a bottom surface of the large-tank rear attaching portion 66 of the storage tank 10 is placed in a state where the bottom surface is in contact and engaged with the bottom surface of the rear attachment-receiving portion 74 of the tank mounting member 48 from above. However, as shown in FIG. 13A, because the attaching-side locking portion 66*a* of the large-tank rear attaching portion 66 of the storage tank 10 and the corresponding attachment receiving-side locking portion 74*a* of the rear attachment-receiving portion 74 of the tank mounting member 48 are not locked with each other, the attaching-side locking portion 66*a* of the large-tank rear attaching portion 66 of the storage tank 10 is in a state where the attaching-side locking portion 66*a* is not positioned relative to the corresponding attachment receiving-side locking portion 74*a* of the rear attachment-receiving portion 74 of the tank mounting member 48 (a pre-positioning state). Then, when the storage tank 10 is moved rearward relative to the tank mounting member 48, the large-tank rear attaching portion 66 of the storage tank 10 in the state shown in FIG. 13A is moved rearward (in an arrow R direction in FIG. 13A) relative to the rear attachment-receiving portion 74 of the tank mounting member 48. Then, as shown in FIG. 13B, the attaching-side locking portion 66*a* of the large-tank rear attaching portion 66 of the storage tank 10 and the corresponding attachment receiving-side locking portion 74*a* of the rear attachment-receiving portion 74 of the tank mounting member 48 are locked with each other. That is, as shown in FIG. 13B, a rear end portion of the locking projection 66*b* of the attaching-side locking portion 66*a* of the large-tank rear attaching portion 66 of the storage tank 10 abuts against a front surface of the locking projection 74*b* of the attachment receiving-side locking portion 74*a* of the rear attachment-receiving portion 74 of the tank mounting member 48. At this time, the front end portion of the attachment receiving-side locking portion 74*a* of the rear attachment-receiving portion 74 of the tank mounting member 48 is fitted inside the locking concave portion 66*c* of the attaching-side locking portion 66*a* of the large-tank rear attaching portion 66 of the storage tank 10. As a result, as shown in FIG. 13B, a state is reached where each attaching-side locking portion 66*a* of the large-tank rear attaching portion 66 of the storage tank 10 is positioned relative to the respective attachment receiving-side locking portion 74*a* of the rear attachment-receiving portion 74 of the tank mounting member 48 (a positioning completion state).

Next, as shown in FIG. 13C, when the storage tank 10 is attached from above to the tank mounting member 48 fixed behind the toilet main body 2, a bottom surface of the small-tank rear attaching portion 68 of the storage tank 10 is placed in a state where the bottom surface is not in contact with the bottom surface of rear attachment-receiving portion 76 of the tank mounting member 48 positioned below the aforementioned bottom surface and a gap G0 is formed. However, as shown in FIG. 13C, because the attaching-side locking portion 68*a* of the small-tank rear attaching portion 68 of the storage tank 10 and the corresponding attachment receiving-side locking portion 76*a* of the rear attachment-receiving portion 76 of the tank mounting member 48 are not locked with each other, the attaching-side locking portion 68*a* of the small-tank rear attaching portion 68 of the storage tank 10 is in a state where the attaching-side locking portion 68*a* is not positioned relative to the corresponding attachment receiving-side locking portion 76*a* of the rear attachment-receiving portion 76 of the tank mounting member 48 (a pre-positioning state). Then, when the storage tank 10 is moved rearward relative to the tank mounting member 48, the small-tank rear attaching portion 68 of the storage tank 10 in the state shown in FIG. 13C is moved rearward (in an arrow R direction in FIG. 13C) relative to the rear attachment-receiving portion 76 of the tank mounting member 48. Then, as shown in FIG. 13D, the attaching-side locking portion 68*a* of the small-tank rear attaching portion 68 of the storage tank 10 and the corresponding attachment receiving-side locking portion 76*a* of the rear attachment-receiving portion 76 of the tank mounting member 48 are locked with each other. That is, as shown in FIG. 13D, a rear end portion of the locking projection 68*b* of the attaching-side locking portion 68*a* of the small-tank rear attaching portion 68 of the storage tank 10 abuts against a front surface of the locking projection 76*b* of the attachment receiving-side locking portion 76*a* of the rear attachment-receiving portion 76 of the tank mounting member 48. At this time, the front end portion of the attachment receiving-side locking portion 76*a* of the rear attachment-receiving portion 76 of the tank mounting member 48 is fitted inside the locking concave portion 68*c* of the attaching-side locking portion 68*a* of the small-tank rear attaching portion 68 of the storage tank 10. As a result, as shown in FIG. 13D, a state is reached where each attaching-side locking portion 68*a* of the small-tank rear attaching portion 68 of the storage tank 10 is positioned relative to the respective attachment receiving-side locking portion 76*a* of the rear attachment-receiving portion 76 of the tank mounting member 48 (a positioning completion state). At this time, a state is maintained where the bottom surface of the small-tank rear attaching portion 68 of the storage tank 10 is not in contact with the bottom surface of rear attachment-receiving portion 76 of the tank mounting member 48 positioned below the aforementioned bottom surface and the gap G0 is formed.

Furthermore, as shown in FIGS. 13A to 13D, the locking projections 74*b*, 76*b* of the locking portions 74*a*, 76*a* of the rear attachment-receiving portions 74, 76 of the tank mounting member 48 include, respectively, sloping surfaces 74*c*, 76*c* sloping obliquely downward to the front from upper ends of the locking projections 74*b*, 76*b*. Accordingly, even if, at the time of attachment of the rear attaching portions 66, 68 of the storage tank 10 to the corresponding rear attachment-receiving portions 74, 76 of the tank mounting member 48 from above, the attaching-side locking portions 66*a*, 68*a* of the rear attaching portions 66, 68 of the storage tank 10 are placed on top of the sloping surfaces 74*c*, 76*c* or the upper ends of the locking projections 74*b*, 76*b* of the attachment-receiving portions 74, 76 of the tank mounting member 48 from above, the sloping surfaces 74*c*, 76*c* may function as guiding surfaces for guiding the corresponding locking portions 66*a*, 68*a* of the attaching portions 66, 68 of the storage tank 10 from the back to ranges inside the attachment-receiving portions 74, 76 of the tank mounting member 48 in front.

Figure 14A:
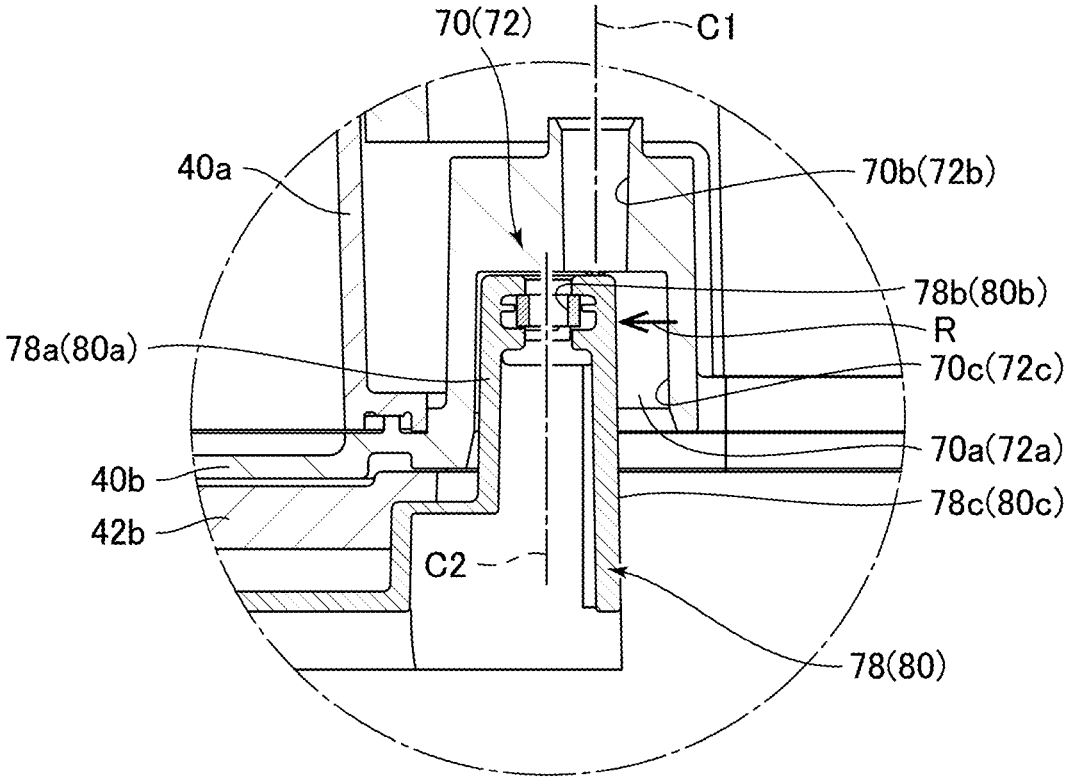
FIG. 14A is an enlarged partial cross-sectional view showing a part of the flush toilet according to the first embodiment of the present invention shown in FIG. 11 in an enlarged manner, the part corresponding to a front attaching portion of the storage tank and a front attachment-receiving portion of the tank mounting member, FIG. 14A showing a state before the front attaching portion of the storage tank is moved rearward after being engaged with the front attachment-receiving portion of the tank mounting member from above (a pre-positioning state)
Figure 14B:
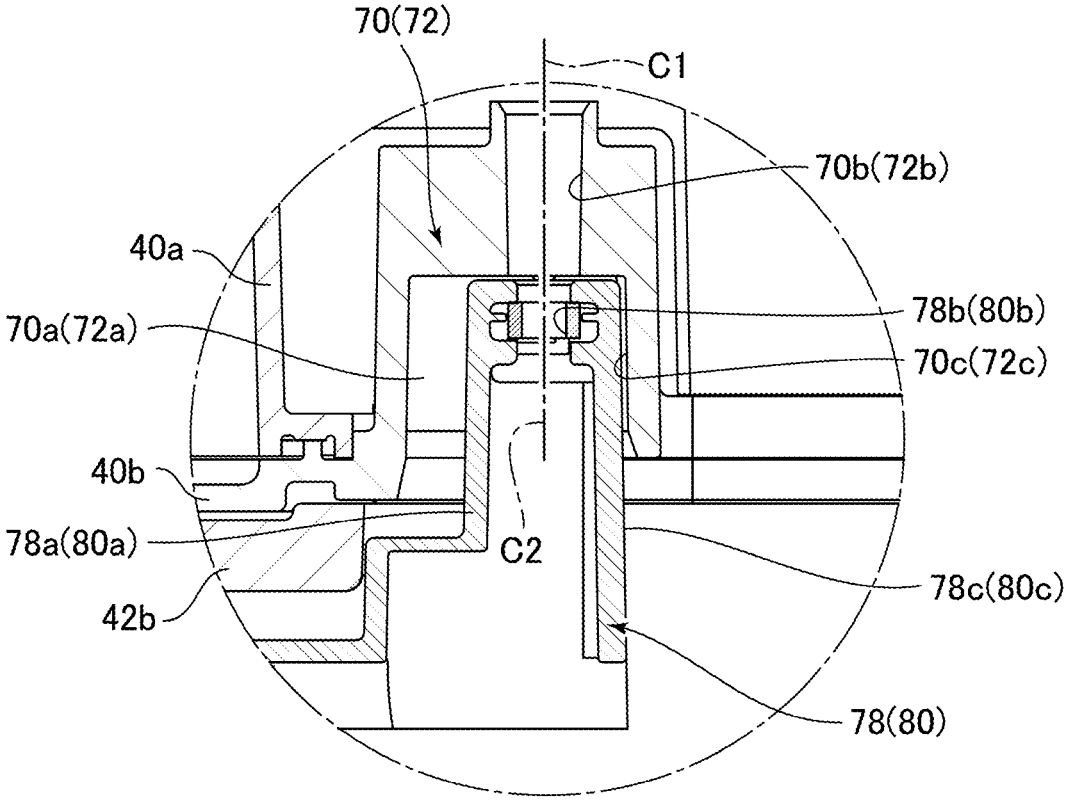
FIG. 14B is, like FIG. 14A, an enlarged partial cross-sectional view showing a part of the flush toilet according to the first embodiment of the present invention in an enlarged manner, the part corresponding to the front attaching portion of the storage tank and the front attachment-receiving portion of the tank mounting member, FIG. 14B showing a state where the front attaching portion of the storage tank is moved rearward after being engaged with the front attachment-receiving portion of the tank mounting member from above and positioning is completed (a positioning completion state)

Next, FIG. 14A is an enlarged partial cross-sectional view showing a part of the flush toilet according to the first embodiment of the present invention shown in FIG. 11 in an enlarged manner, the part corresponding to the front attaching portion of the storage tank and the front attachment-receiving portion of the tank mounting member, FIG. 14A showing a state before the front attaching portion of the storage tank is moved rearward after being engaged with the front attachment-receiving portion of the tank mounting member from above (a pre-positioning state). FIG. 14B is, like FIG. 14A, an enlarged partial cross-sectional view, and shows a state where the front attaching portion of the storage tank is moved rearward after being engaged with the front attachment-receiving portion of the tank mounting member from above and positioning is completed (a positioning completion state). As shown in FIGS. 14A and 14B, each front attaching portion 70, 72 of the storage tank 10 and the corresponding front attachment-receiving portion 78, 80 of the tank mounting member 48 are screw-fixing portions that can be screw-fixed to each other (hereinafter referred to as "the screw-fixing portion(s) 70, 72 of the storage tank 10" and "the screw-fixing portion(s) 78, 80 of the tank mounting member 48"). Specifically, as shown in FIGS. 14A and 14B, the screw-fixing portions 78, 80 of the tank mounting member 48 include protruding portions 78*a*, 80*a* protruding upward from both left and right sides in a front region of the base plate 50, and screw holes (lower screw holes 78*b*, 80*b*) penetrating the protruding portions 78*a*, 80*a* in an up-down direction.

As shown in FIGS. 14A and 14B, fitting concave portions 70*a*, 72*a* where the protruding portions 78*a*, 80*a* of the screw-fixing portions 78, 80 of the tank mounting member 48 can be inserted from below are provided below the screw-fixing portions 70, 72 of the storage tank 10. Furthermore, the fitting concave portions 70*a*, 72*a* of the storage tank 10 are formed larger than a dimension of the protruding portions 78*a*, 80*a* of the screw-fixing portions 78, 80 of the tank mounting member 48 in the front-back direction. Accordingly, in a state where the fitting concave portions 70*a*, 72*a* of the storage tank 10 are fitted (engaged) with the corresponding protruding portions 78*a*, 80*a* of the screw-fixing portions 78, 80 of the tank mounting member 48, the screw-fixing portions 70, 72 of the storage tank 10 are capable of sliding in the front-back direction relative to the corresponding screw-fixing portions 78, 80 of the tank mounting member 48.

Furthermore, screw holes (upper screw holes 70*b*, 72*b*) penetrating in the up-down direction are formed above the corresponding fitting concave portions 70*a*, 72*a* of the screw-fixing portions 70, 72 of the storage tank 10. As shown in FIG. 14A, in a state where the front attaching portions 70, 72 of the storage tank 10 are attached and engaged with the corresponding front attachment-receiving portions 78, 80 of the tank mounting member 48 from above but are not yet moved rearward (the pre-positioning state), front ends 70*c*, 72*c* of the fitting concave portions 70*a*, 72*a* of the screw-fixing portions 70, 72 of the storage tank 10 are separate from front ends 78*c*, 80*c* of the protruding portions 78*a*, 80*a* of the screw-fixing portions 78, 80 of the tank mounting member 48. At this time, as shown in FIG. 14A, a central axis C1 of the upper screw holes 70*b*, 72*b* of the screw-fixing portions 70, 72 of the storage tank 10 is at a position more forward than a central axis C2 of the lower screw holes 78*b*, 80*b* of the screw-fixing portions 78, 80 of the tank mounting member 48, and the upper screw holes 70*b*, 72*b* do not coincide with the corresponding lower screw holes 78*b*, 80*b*.

Then, when the storage tank 10 is moved rearward relative to the tank mounting member 48, the screw-fixing portions 70, 72 of the storage tank 10 in the state shown in FIG. 14A move rearward (in the arrow R direction in FIG. 14A) relative to the corresponding rear attachment-receiving portions 74, 76 of the tank mounting member 48. As shown in FIG. 14B, the front ends 70*c*, 72*c* of the fitting concave portions 70*a*, 72*a* of the screw-fixing portions 70, 72 of the storage tank 10 thus abut against the corresponding front ends 78*c*, 80*c* of the protruding portions 78*a*, 80*a* of the screw-fixing portions 78, 80 of the tank mounting member 48. At this time, as shown in FIG. 14B, the central axis C1 of the upper screw holes 70*b*, 72*b* of the screw-fixing portions 70, 72 of the storage tank 10 coincides with the central axis C2 of the corresponding lower screw holes 78*b*, 80*b* of the screw-fixing portions 78, 80 of the tank mounting member 48, and positioning of the screw-fixing portions 70, 72 of the storage tank 10 and the screw-fixing portions 78, 80 of the tank mounting member 48 is completed. Then, when common screw members 82 (see FIGS. 7 and 9) are fastened into the coinciding upper screw holes 70*b*, 72*b* and lower screw holes 78*b*, 80*b*, the screw-fixing portions 70, 72 of the storage tank 10 are fixed to the screw-fixing portions 78, 80 of the tank mounting member 48.

As a result, as shown in FIGS. 13A to 14B, when the attaching portions 66, 68, 70, 72 of the storage tank 10 and the corresponding attachment-receiving portions 74, 76, 78, 80 of the tank mounting member 48 are attached to each other, two positions are locked, that is, the attaching-side locking portions 66*a*, 68*a* of the rear attaching portions 66, 68 of the storage tank 10 and the corresponding attachment receiving-side locking portions 74*a*, 76*a* of the rear attachment-receiving portions 74, 76 of the tank mounting member 48 are locked, and attaching property of the storage tank 10 to the tank mounting member 48 is improved, and also, positioning of the front attaching portions (screw-fixing portions) 70, 72 of the storage tank 10 fixed by the screw members 82 relative to the corresponding front attaching portions (screw-fixing portions) 78, 80 of the tank mounting member 48 is facilitated. Furthermore, in a state where the attaching portions 66, 68, 70, 72 of the storage tank 10 and the corresponding attachment-receiving portions 74, 76, 78, 80 of the tank mounting member 48 are attached to each other, the bottom surface of the large-tank rear attaching portion 66 of the storage tank 10 is in contact with the bottom surface of the rear attachment-receiving portion 74 of the tank mounting member 48 while a state is maintained in relation to the bottom surface of the small-tank rear attaching portion 68 of the storage tank 10, where the bottom surface is not in contact with the bottom surface of the rear attachment-receiving portion 76 of the tank mounting member 48 positioned below the aforementioned bottom surface and the gap G0 is formed. Accordingly, compared with a structure where the bottom surface of the small-tank rear attaching portion 68 of the storage tank 10 is fixed by being in contact with the bottom surface of the rear attachment-receiving portion 76 of the tank mounting member 48 positioned below the aforementioned bottom surface, the storage tank 10 may be prevented from being fixed to the tank mounting member 48 in an excessively twisted state, and also, from a long-term perspective, strength of the storage tank 10 may be prevented from becoming low. Furthermore, even if the storage tank 10 that is attached to the tank mounting member 48 is tilted to the large tank section 44 side with a large capacity (toward which the center of gravity is biased), there is no gap between the bottom surface of the large-tank rear attaching portion 66 of the storage tank 10 and the bottom surface of the rear attachment-receiving portion 74 of the tank mounting member 48 (or the gap is smaller than on the small-tank rear attaching portion 68 side) and the bottom surface of the large-tank rear attaching portion 66 of the storage tank 10 is landed (or is capable of swiftly landing), and thus, the amount of deformation when the storage tank 10 is tilted may be made small.

Next, as shown in FIGS. 3 to 5, 7 and 9, an air vent port 46*d* is formed vertically penetrating the second upper surface (the upper surface 46*b*), of the small tank section 46, that is at the position P5 that is lower than the position P3 of the first upper surface (the upper surface 44*b*) of the large tank section 44 of the storage tank 10. The air vent port 46*d* functions as an air vent unit that allows purging of air from the storage tank 10. Furthermore, as shown in FIGS. 3 to 5, 7 and 9, the small tank section 46 includes a third upper surface (an upper surface 46*e*) that is at a position P8 that is lower than the position P5 of the second upper surface (the upper surface 46*b*). The third upper surface (the upper surface 46*e*) of the small tank section 46 is provided between the first upper surface (the upper surface 44*b*) of the large tank section 44 and the second upper surface (the upper surface 46*b*) of the small tank section 46 of the storage tank 10 in the left-right direction. Furthermore, as shown in FIG. 4, an air vent device 84 (of which more later) for opening/closing the air vent port 46*d* is provided below the upper surface 46*b*, at the height position P5, of the small tank section 46 of the storage tank 10. The air vent device 84 functions as the air vent unit that allows purging of air from the storage tank 10. Furthermore, the air vent device 84 includes an air vent valve 86 that is housed in an air communication region Q at an upper part inside the small tank section 46 of the storage tank 10. The air vent valve 86 is a so-called "float valve" that is capable of vertically moving by buoyancy according to a water level inside the air communication region Q at the upper part inside the small tank section 46, and the air vent port 46*d* is opened/closed according to the vertical movement of the float valve.

Figure 15A:
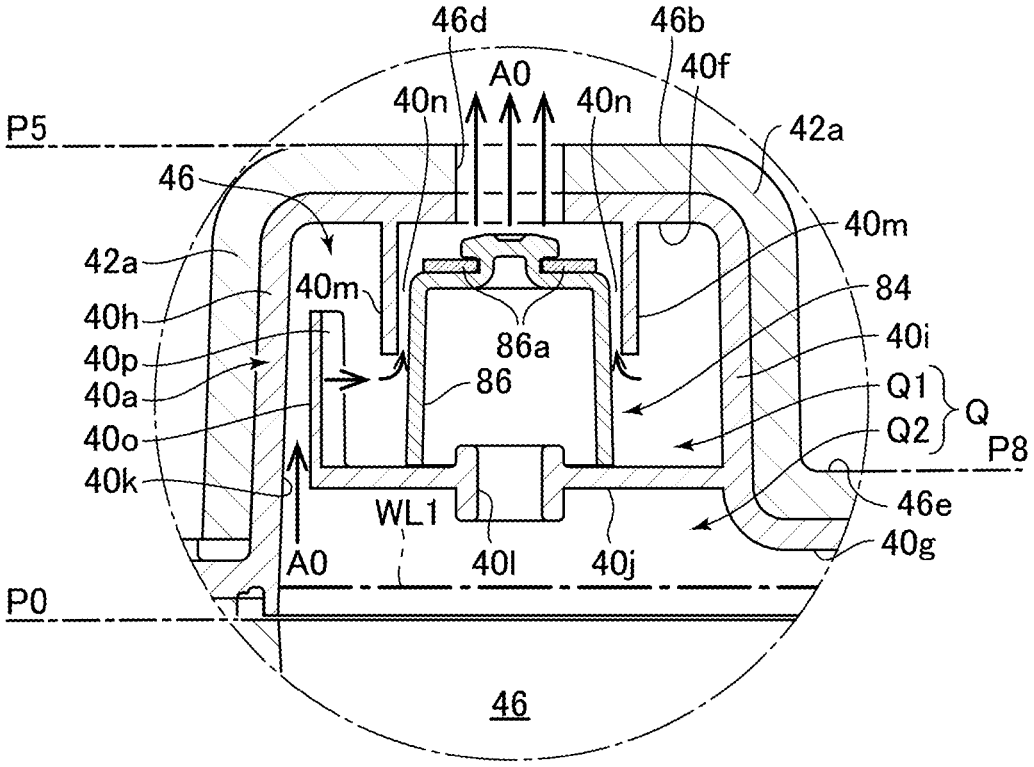
FIG. 15A is an enlarged partial cross-sectional view showing, in an enlarged manner, a part corresponding to an air vent device, of a tank device of the flush toilet according to the first embodiment of the present invention shown in FIG. 4, FIG. 15A showing a state where an air vent valve is open.
Figure 15B:
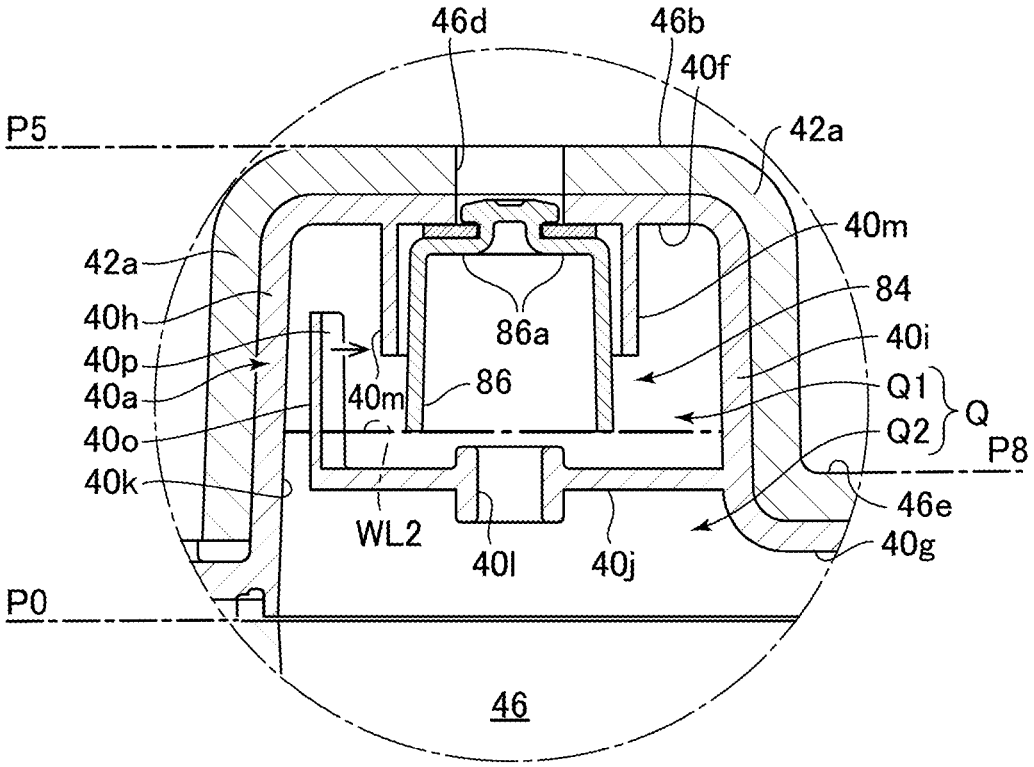
FIG. 15B is, like FIG. 15A, an enlarged partial cross-sectional view showing, in an enlarged manner, the part corresponding to the air vent device, of the tank device of the flush toilet according to the first embodiment of the present invention, FIG. 15B showing a state where the air vent valve is closed.

Next, details of the air vent device 84 will be given with reference to FIGS. 15A and 15B. FIGS. 15A and 15B are enlarged partial cross-sectional views showing, in an enlarged manner, the part corresponding to the air vent device, of the tank device of the flush toilet according to the first embodiment of the present invention shown in FIG. 4, where a state where the air vent valve is open and a state where the air vent valve is closed are shown, respectively. First, as shown in FIGS. 15A and 15B, with the air vent device 84, an upper part of the upper tank main body 40*a* inside the small tank section 46 forms the air communication region Q where the air vent valve 86 is housed. Furthermore, the upper part of the upper tank main body 40*a* forming the air communication region Q has the air vent port 46*d* formed therein, and further includes an upper top surface 40*f* that is positioned higher than the third upper surface 46*e* of the small tank section 46. Moreover, the upper tank main body 40*a* forming the air communication region Q includes a lower top surface 40*g* that is positioned lower than the upper top surface 40*f* and the third upper surface 46*e* of the small tank section 46 and higher than the middle height position P0 of the storage tank 10.

Next, as shown in FIGS. 15A and 15B, the upper part of the upper tank main body 40*a* forming the air communication region Q includes a left wall portion 40*h* and a right wall portion 40*i* that are provided facing each other in the horizontal left-right direction. Furthermore, the right wall portion 40*i* of the upper tank main body 40*a* is provided to connect one end portion of the upper top surface 40*f* in the horizontal left-right direction (a right end portion of the upper top surface 40*f* in the horizontal left-right direction shown in FIGS. 15A and 15B) and other end portion of the lower top surface 40*g* in the horizontal left-right direction (a left end portion of the lower top surface 40*g* in the horizontal left-right direction shown in FIGS. 15A and 15B). Moreover, at a lower part of the right wall portion 40*i* of the upper tank main body 40*a*, a seating wall portion 40*j* that extends in the horizontal left-right direction is formed at a position higher than a height position of the lower top surface 40*g*. The seating wall portion 40*j* functions as a seat where the air vent valve 86, that is a float valve, is to be disposed.

A gap is formed between an end portion, of the seating wall portion 40*j*, on one side (a left end portion shown in FIGS. 15A and 15B) and the left wall portion 40*h*, and the gap is, in effect, a communicating passage 40*k* that allows air and flush water inside the storage tank 10 to pass through. Furthermore, a communicating port 401 is formed at a center portion of the seating wall portion 40*j* in the left-right direction in a manner penetrating in the up-down direction. Moreover, an upper region (the air communication region Q) inside the small tank section 46 is divided by the seating wall portion 40*j* into an upper region Q1 and a lower region Q2 that are vertically positioned relative to each other, and the regions Q1 and Q2 are capable of communicating with each other through the communicating port 401. Additionally, in addition to the communicating port 401, a plurality of small communicating holes (not shown) may be provided in the seating wall portion 40*j* in a manner penetrating in the up-down direction.

Next, as shown in FIGS. 15A and 15B, the air vent valve 86, that is a float valve, has an approximately cylindrical shape whose lower end portion is open and upper end portion is closed, and a valve body 86*a* is provided at the upper end portion of the air vent valve 86. An annular guide wall portion 40*m* that extends downward from the upper top surface 40*f* is provided on an outer circumferential side of the air vent valve 86. The guide wall portion 40*m* functions as a guiding portion for stabilizing vertical movement of the air vent valve 86 that is a float valve. Furthermore, in a state where the air vent valve 86 is open (see FIG. 15A), a communicating passage 40*n* for allowing air to pass through is formed between an outer circumferential surface of the air vent valve 86 and an inner circumferential surface of the guide wall portion 40*m*. Moreover, a vertically long slit 40*p* is formed in a vertical wall portion 40*o* that is on outside of the guide wall portion 40*m* and that is adjacent to the communicating passage 40*k* while extending upward from the seating wall portion 40*j*. The communicating passage 40*k*, the slit 40*p*, and the communicating passage 40*n* communicate with one another.

Accordingly, for example, when a water level inside the small tank section 46 (inside the air communication region Q) is at a water level WL1 that is lower than the seating wall portion 40*j*, the air vent valve 86 is in a lowered state and an upper surface of the valve body 86*a* keeps the air vent port 46*d* open (see FIG. 15A). Accordingly, an air lock A0 inside the upper region (the air communication region Q) in the small tank section 46 communicates with air outside the storage tank 10 to be released to outside, through the communicating passage 40*k*, the slit 40*p*, the communicating passage 40*n*, and the air vent port 46*d* opened by the valve body 86*a* of the air vent valve 86. By contrast, when the water level inside the small tank section 46 (inside the air communication region Q) rises to at least a water level WL2 that is higher than the seating wall portion 40*j*, the air vent valve 86 is raised by buoyancy that is applied by the flush water at the water level WL2, and the upper surface of the valve body 86*a* blocks the air vent port 46*d* (see FIG. 15B).

Figure 16:
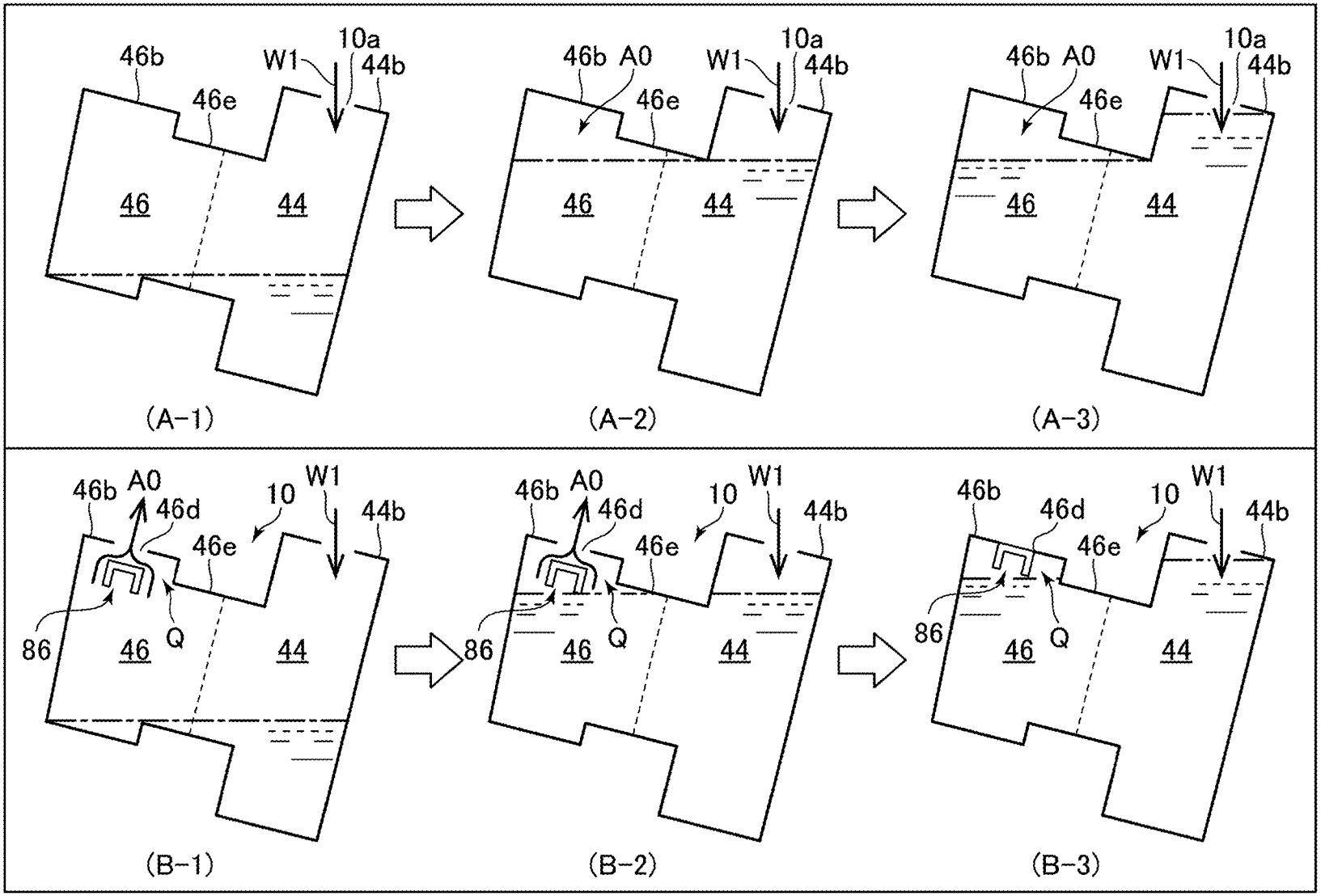
FIG. 16 is a diagram schematically showing, as a comparative example for the storage tank of the tank device of the flush toilet according to the first embodiment of the present invention, a storage tank that does not include an air vent port and an air vent device on an upper surface of a small tank section, where the storage tank is in a tilted state, and the diagram chronologically shows, in (A-1), (A-2) and (A-3), a rise in a water level and a state of air lock in the storage tank during supply of flush water.

Next, effects of the flush toilet 1 according to the first embodiment of the present invention described above will be described with reference to FIGS. 1 to 16. FIG. 16 is a diagram schematically showing, as a comparative example for the storage tank of the tank device of the flush toilet according to the first embodiment of the present invention, a storage tank that does not include an air vent port and an air vent device on an upper surface of a small tank section, where the storage tank is in a tilted state, and the diagram chronologically shows, in (A-1), (A-2) and (A-3), a rise in a water level and a state of air lock in the storage tank during supply of flush water. Furthermore, FIG. 16 is a diagram schematically showing the storage tank of the tank device of the flush toilet according to the first embodiment of the present invention, where the storage tank is in a tilted state, and the diagram chronologically shows, in (B-1), (B-2), and (B-3), a rise in a water level and a state of air lock in the storage tank during supply of flush water.

First, because the storage tank 10 of the tank device 4 of the flush toilet 1 according to the first embodiment of the present invention has a shape that is asymmetrical in the left-right direction due to the large tank section 44 and the small tank section 46, the amount of stored water in the large tank section and the amount of stored water in the small tank section are different in the left-right direction. Accordingly, the storage tank 10 is in a state where the entire storage tank 10 is easily tilted with outside of the large tank section 44 with a large amount of stored water (large weight) lowered relative to the center of gravity of the storage tank 10 and outside of the small tank section 46 with a small amount of stored water (small weight) raised relative to the center of gravity of the storage tank 10. Now, a case is assumed, as shown in (A-1), (A-2) and (A-3) in FIG. 16, where the tank device 4 of the flush toilet 1 according to the present embodiment does not include the air vent port 46*d* and the air vent device 84 at the upper surface 46*b* of the small tank section 46 of the storage tank 10. In this case, because the upper surface 46*b* of the small tank section 46 is at a position lower than the upper surface 44*b* of the large tank section 44 and there is a height difference between the upper surfaces 44*b* and 46*b*, and also because the water passage port 10*a* is provided in the upper surface 44*b* of the large tank section 44, when the storage tank 10 is tilted, air in the upper region of the large tank section 44 is released to outside through the water passage port 10*a* and the air lock A0 is not easily formed. By contrast, because the air vent port 46*d* and the air vent device 84 are not provided at the upper surface 46*b* of the small tank section 46 of the storage tank 10, the air lock A0 is formed especially in the upper region (the air communication region Q) of the small tank section 46 of the storage tank 10, and the air lock A0 becomes a spatial region that cannot be used as a region where water can be stored (see (A-2) and (A-3) in FIG. 16).

By contrast, as shown in (B-1), (B-2) and (B-3) in FIG. 16, with the flush toilet 1 of the present embodiment, even if the air lock A0 is formed inside the storage tank 10 at the time of flush water W1 supplied from the water supply unit (the water supply nozzle 6*a*) flowing into the storage tank 10 through the water passage port 10*a* of the storage tank 10, the water passage port 10*a* provided in the first upper surface (the upper surface 44*b* of the large tank section 44) of the storage tank 10 may function as the air vent port that facilitates escape of air of the air lock A0. Furthermore, the flush water W1 that is supplied from the water supply unit (the water supply nozzle 6*a*) flows into the storage tank 10 after passing through the water passage port 10*a* in the first upper surface (the upper surface 44*b* of the large tank section 44) of the storage tank 10, and the water level rises in both the large tank section 44 and the small tank section 46 of the storage tank 10. The entire upper surface of the storage tank 10 is formed unevenly due to the first upper surface (the upper surface 44*b* of the large tank section 44) where the water passage port 10*a* is provided, the second upper surface (the upper surface 46*b* of the small tank section 46) that is lower than the first upper surface (the upper surface 44*b* of the large tank section 44), and the third upper surface (the upper surface 46*e* of the small tank section 46) that is lower than the second upper surface (the upper surface 46*b* of the small tank section 46) and that is provided between the first upper surface (the upper surface 44*b* of the large tank section 44) and the second upper surface (the upper surface 46*b* of the small tank section 46). Accordingly, for example, when the water level, in the storage tank 10, that is lower than the third upper surface (the upper surface 46*e* of the small tank section 46) rises and reaches the third upper surface (the upper surface 46*e* of the small tank section 46; see (B-2) in FIG. 16), and then, further rises to a height position between the height position P8 of the third upper surface (the upper surface 46*e* of the small tank section 46) and the height position P5 of the second upper surface (the upper surface 46*b* of the small tank section 46; see FIG. 15B and (B-3) in FIG. 16), a state is temporarily reached where the air lock A0 is easily formed in the air communication region Q between the water level WL1, WL2 and the second upper surface (the upper surface 46*b* of the small tank section 46). However, with the tank device 4 of the present embodiment, the air vent unit (the air vent port 46*d*, and the air vent valve 86 of the air vent device 84) is provided at the second upper surface (the upper surface 46*b* of the small tank section 46) of the storage tank 10. Accordingly, purging of air from the storage tank 10 is enabled, and air in the air communication region Q may be released to outside. Accordingly, the air lock A0 between the water surface WL1, WL2 in the small tank section 46 of the storage tank 10 and the second upper surface (the upper surface 46*b* of the small tank section 46) may be released to outside through the air vent unit (the air vent port 46*d*, and the air vent valve 86 of the air vent device 84). Furthermore, the water level WL1 that is lower than the third upper surface (the upper surface 46*e* of the small tank section 46) of the storage tank 10 rises (see FIG. 15A), and reaches the height position of the upper surface 46*e* of the small tank section 46 (see (B-2) in FIG. 16). Then, when the water level inside the small tank section 46 further rises to the water level WL2 at a height position between the height position P8 of the upper surface 46*e* of the small tank section 46 and the height position P5 of the upper surface 46*b* of the small tank section 46 (see FIG. 15B), air of the air lock A0 in the upper region (the air communication region Q) of the small tank section 46 of the storage tank 10 is allowed to easily escape through the air vent port 46*d* that is opened by the air vent valve 86. Therefore, according to the present embodiment, thanks to the air vent unit (the air vent port 46*d*, and the air vent valve 86 of the air vent device 84) described above, generation of the air lock A0 inside the entire storage tank 10 may be effectively reduced compared with the spatial region (the region of the air lock A0) inside the storage tank 10, shown in (A-2) and (A-3) in FIG. 16, that cannot be used as a region where water can be stored, and thus, the spatial region, inside the entire storage tank 10, where water cannot be stored (the region of the air lock A0) may be reduced, and a water storage region where flush water can be stored may be maximized. Furthermore, generation of abnormal sounds due to the air lock A0 inside the storage tank 10 (such as abnormal sounds that are generated when the air lock A0 inside the storage tank 10 is captured during water supply, abnormal sounds that are generated at the time of deaeration of the air of the air lock A0 from the water passage port 10*a* or the air vent port 46*d* (degassing sounds), and the like) may also be effectively prevented. Furthermore, the amount of flush water that is supplied from the water supply unit (the water supply nozzle 6*a*) and stored in the storage tank 10 may be prevented from being reduced or varied due to the air lock A0 in the storage tank 10. Accordingly, a greater amount of flush water can be stored in the storage tank 10.

Furthermore, with the flush toilet 1 according to the present embodiment, the storage tank 10 has a shape that is asymmetrical in the left-right direction due to the large tank section 44 and the small tank section 46, and thus, the amount of stored water in the large tank section 44 and the amount of stored water in the small tank section 46 are different in the left-right direction. Accordingly, the storage tank 10 is in a state where the entire storage tank 10 is easily tilted with outside of the large tank section 44 with a large amount of stored water (large weight) lowered relative to the center of gravity of the storage tank 10 and outside of the small tank section 46 with a small amount of stored water (small weight) raised relative to the center of gravity of the storage tank 10. With such tilting of the entire storage tank 10, escape of air of the air lock A0 especially at the upper part in the small tank section 46 of the storage tank 10 from the air vent unit (the air vent port 46*d*, and the air vent valve 86 of the air vent device 84) at the upper surface 46*b* of the small tank section 46 may be facilitated. Accordingly, the air lock A0 between the water surface WL1, WL2 in the small tank section 46 of the storage tank 10 and the second upper surface (the upper surface 46*b* of the small tank section 46) may be released to outside through the air vent unit (the air vent port 46*d*, and the air vent valve 86 of the air vent device 84; see FIGS. 15A and 15B). Accordingly, generation of the air lock A0 inside the storage tank 10 (especially inside the small tank section 46) may be effectively prevented by the air vent unit (the air vent port 46*d*, and the air vent valve 86 of the air vent device 84). Furthermore, generation of abnormal sounds due to the air lock A0 inside the storage tank 10 (such as abnormal sounds that are generated when the air lock A0 inside the storage tank 10 is captured during water supply, abnormal sounds that are generated at the time of deaeration of the air of the air lock from the water passage port 10*a* or the air vent port 46*d* (degassing sounds), and the like) may also be effectively prevented. Accordingly, generation of abnormal sounds due to the air lock A0 inside the storage tank 10 (such as abnormal sounds that are generated when the air lock A0 inside small tank section 46 of the storage tank 10 is captured during water supply to the storage tank 10, abnormal sounds that are generated at the time of deaeration of the air of the air lock A0 inside small tank section 46 of the storage tank 10 from the water passage port 10*a* in the upper surface 44*b* of the large tank section 44 or the air vent port 46*d* in the upper surface 46*b* of the small tank section 46 (degassing sounds), and the like) may also be effectively prevented. Furthermore, the amount of flush water that is supplied from the water supply unit (the water supply nozzle 6*a*) and stored in the large tank section 44 and the small tank section 46 of the storage tank 10 may be prevented from being reduced or varied due to the air lock A0 in the storage tank 10 (especially in the small tank section 46). Accordingly, a greater amount of flush water may be stored in the large tank section 44 and the small tank section 46 of the storage tank 10. Moreover, because the entire storage tank 10 is allowed to have a shape that is asymmetrical in the left-right direction due to the large tank section 44 and the small tank section 46 of the storage tank 10, freedom may be increased in relation to design and layout of peripheral units to be arranged in the periphery of the storage tank 10 of the tank device 4.

Figure 17:
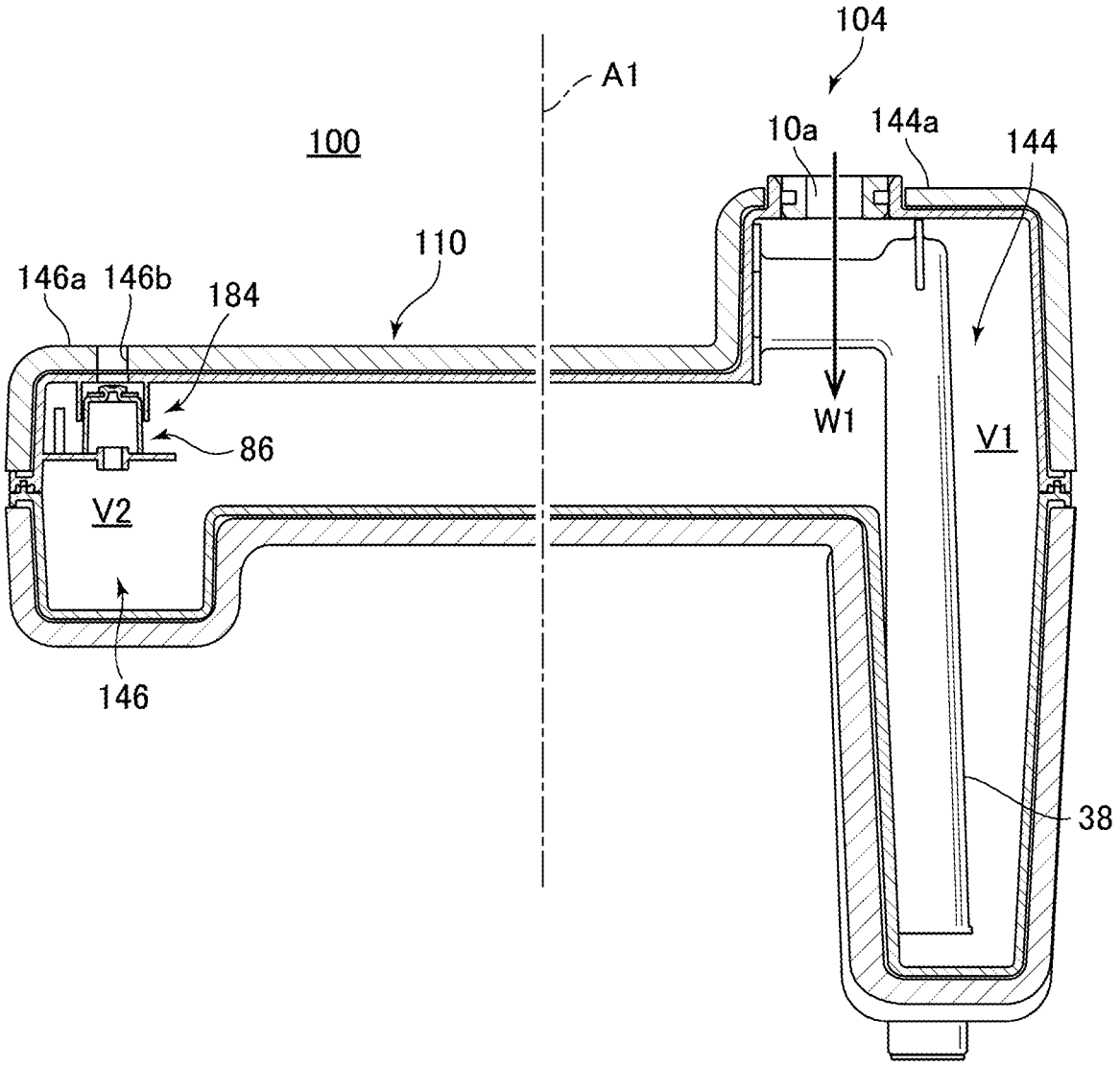
FIG. 17 is a schematic front cross-sectional view of a storage tank and an air vent device of a tank device of a flush toilet according to a second embodiment of the present invention.
Figure 18A:
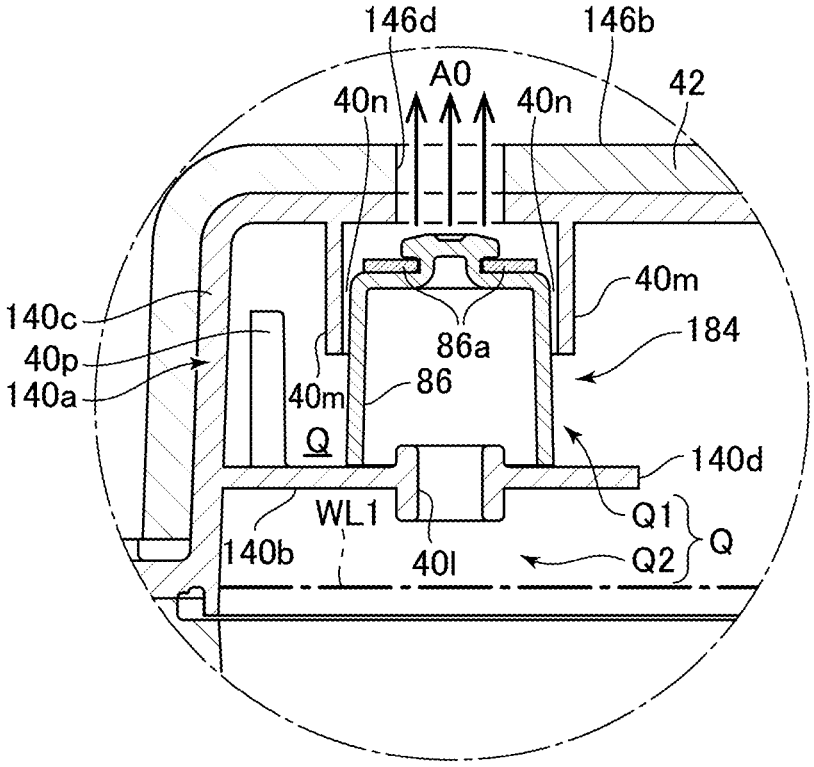
FIG. 18A is an enlarged partial cross-sectional view showing, in an enlarged manner, a part corresponding to the air vent device, of the tank device of the flush toilet according to the second embodiment of the present invention shown in FIG. 17, FIG. 18A showing a state where an air vent valve is open.
Figure 18B:
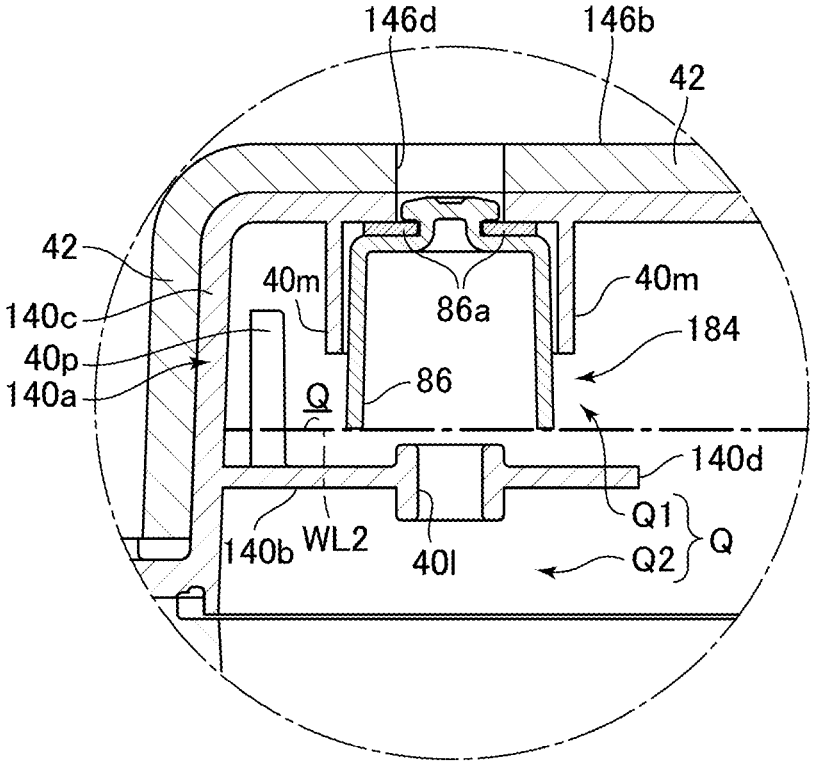
FIG. 18B is, like FIG. 18A, an enlarged partial cross-sectional view showing, in an enlarged manner, the part corresponding to the air vent device, of the tank device of the flush toilet according to the second embodiment of the present invention, FIG. 18B showing a state where the air vent valve is closed.

Next, a storage tank 110 of a tank device 104 of a flush toilet 100 according to a second embodiment of the present invention will be described with reference to FIGS. 17 to 18B. First, FIG. 17 is a schematic front cross-sectional view of the storage tank and an air vent device of the tank device of the flush toilet according to the second embodiment of the present invention. Furthermore, FIGS. 18A and 18B are enlarged partial cross-sectional views showing, in an enlarged manner, a part corresponding to the air vent device, of the tank device of the flush toilet according to the second embodiment of the present invention, FIGS. 18A and 18B showing a state where an air vent valve is open and a state where the air vent valve is closed, respectively. Here, parts of the storage tank 110 and an air vent device 184 of the tank device 104 of the flush toilet 100 according to the second embodiment of the present invention shown in FIGS. 17 to 18B that are the same as those of the storage tank 10 and the air vent device 84 of the tank device 4 of the flush toilet 1 according to the first embodiment of the present invention shown in FIGS. 4, 15A and 15B are denoted by same reference signs, and description thereof is omitted.

As shown in FIGS. 17 to 18B, with the flush toilet 100 of the second embodiment of the present invention, the shape of the storage tank 110 of the tank device 104 is different from the shape of the storage tank 10 of the tank device 4 of the flush toilet 1 of the first embodiment. Specifically, the storage tank 110 of the present embodiment includes a first upper surface (an upper surface 144*a* of a large tank section 144), and a second upper surface (an upper surface 146*a* of a small tank section 146) that is lower than the first upper surface. With the storage tank 110 of the present embodiment, the upper surface 146*a* of the small tank section 146 horizontally extends in the left-right direction to the large tank section 144 while being at a certain height, and thus has a shape that is different from the uneven shape of the small tank section 46, of the storage tank 10 of the first embodiment described above, including the upper surfaces 46*b*, 46*e* with a height different. Furthermore, the storage tank 110 of the present embodiment includes, as an air vent unit, an air vent port 146*b* that is formed in the upper surface 146*a* of the small tank section 146 and the air vent device 184 for opening/closing the air vent port 146*b*, and the structure of the air vent device 184 is different from the structure of the air vent device 84 of the first embodiment described above. Specifically, as shown in FIGS. 18A and 18B, with the air vent device 184 of the present embodiment, a seating wall portion 140*b* of an upper tank main body 140*a* of the small tank section 146 of the storage tank 110 horizontally extends in the left-right direction from a left wall portion 140*c* of the upper tank main body 140*a*, and one end portion (an inner end portion 140*d* on the right side in FIGS. 18A and 18B) is positioned at a predetermined position lower and on the right side of the air vent valve 86. Furthermore, an upper region (the air communication region Q) inside the small tank section 146 is divided by the seating wall portion 140*b* into the upper region Q1 and the lower region Q2 that are vertically positioned relative to each other, and the regions Q1 and Q2 are capable of communicating with each other through the communicating port 401. Moreover, because the upper tank main body 140*a* of the small tank section 146 of the storage tank 110 does not include, on the right side of the air vent valve 86, a side wall portion like the right wall portion 40*i* of the upper tank main body 40*a* of the first embodiment, a right-side region of the air vent valve 86 communicates with the region inside the storage tank 110 at all times.

Accordingly, for example, when a water level inside the small tank section 146 (inside the air communication region Q) is at the water level WL1 that is lower than the seating wall portion 140*b*, the air vent valve 86 is in a lowered state and the upper surface of the valve body 86*a* keeps the air vent port 146*b* open (see FIG. 18A). Accordingly, the air lock A0 inside the upper region (the air communication region Q) in the small tank section 146 communicates with air outside the storage tank 110 to be released to outside through the slit 40*p*, the communicating passage 40*n*, and the air vent port 146*b* opened by the valve body 86*a* of the air vent valve 86. By contrast, when the water level inside the small tank section 146 (inside the air communication region Q) rises to at least the water level WL2 that is higher than the seating wall portion 140*b*, the air vent valve 86 is raised by buoyancy that is applied by the flush water at the water level WL2, and the upper surface of the valve body 86*a* blocks the air vent port 146*b* (see FIG. 18B).

As shown in FIGS. 17 to 18B, with the flush toilet 100 according to the second embodiment of the present invention described above, first, even if the air lock A0 is formed inside the storage tank 110 at the time of water being supplied from the water supply unit (the water supply nozzle 6*a*) to the storage tank 110, the water passage port 10*a* provided in the first upper surface (the upper surface 144*a* of the large tank section 144) of the storage tank 110 may function as the air vent port that facilitates escape of air of the air lock A0. Furthermore, the flush water W1 that is supplied from the water supply unit (the water supply nozzle 6*a*) flows into the storage tank 110 after passing through the water passage port 10*a* in the first upper surface (the upper surface 144*a* of the large tank section 144) of the storage tank 110, and the water level rises in both the large tank section 144 and the small tank section 146 of the storage tank 110. The entire upper surface of the storage tank 110 is formed unevenly due to the first upper surface (the upper surface 144*a* of the large tank section 144) where the water passage port 10*a* is provided and the second upper surface (the upper surface 146*a* of the small tank section 146) that is lower than the first upper surface (the upper surface 144*a* of the large tank section 144). Accordingly, in a state where the water level inside the storage tank 110 is lower than the second upper surface (the upper surface 146*a* of the small tank section 146), a state is temporarily reached where the air lock A0 is easily formed in the air communication region Q between the water surface (see the water level WL1 shown in FIG. 18A and the water level WL2 shown in FIG. 18B) and the second upper surface (the upper surface 146*a* of the small tank section 146). However, because the air vent unit (the air vent port 146*b*, and the air vent valve 86 of the air vent device 184) is formed at the second upper surface (the upper surface 146*a* of the small tank section 146) of the storage tank 110, air can be purged from the storage tank 110 by the air vent unit, and air in the air communication region Q may be released to outside. Accordingly, the air lock A0 between the water surface inside the storage tank 110 (see the water level WL1 shown in FIG. 18A, and the water level WL2 shown in FIG. 18B) and the second upper surface (the upper surface 146*a* of the small tank section 146) may be released to outside through the air vent unit (the air vent port 146*b*, and the air vent valve 86 of the air vent device 184). Therefore, when a water level (see the water level WL1 shown in FIG. 18A) that is lower than the second upper surface (the upper surface 146*a* of the small tank section 146) in the storage tank 110 rises to at least a water level (see the water level WL2 shown in FIG. 18B) that is higher than the seating wall portion 140*b* and comes close to the upper surface 146*a* of the small tank section 146, the air of the air lock A0 in the storage tank 110 is enabled by the air vent unit (the air vent port 146*b*, and the air vent valve 86 of the air vent device 184) to easily escape. Accordingly, thanks to the air vent unit (the air vent port 146*b*, and the air vent valve 86 of the air vent device 184) as described above, generation of the air lock A0 in the storage tank 110 may be effectively prevented. Furthermore, generation of abnormal sounds due to the air lock A0 inside the storage tank 110 (such as abnormal sounds that are generated when the air lock A0 inside the storage tank 110 is captured during water supply, abnormal sounds that are generated at the time of deaeration of the air of the air lock A0 from the water passage port 10*a* (degassing sounds), and the like) may also be effectively prevented. Furthermore, the amount of flush water that is supplied from the water supply unit (the water supply nozzle 6*a*) and stored in the storage tank 110 may be prevented from being reduced or varied due to the air lock A0 in the storage tank 110. Accordingly, a greater amount of flush water can be stored in the storage tank 110.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet for discharging waste with flush water, the flush toilet comprising:

a toilet main body including a bowl configured to receive waste, and a discharge trap configured to discharge the waste in the bowl; and a tank device configured to supply flush water to the toilet main body, wherein the tank device includes a storage tank provided behind the toilet main body and above a floor surface, the storage tank being configured to store the flush water to be supplied to the toilet main body, the tank device further includes a water supply unit configured to supply the flush water to the storage tank, the storage tank includes a first upper surface, a second upper surface, and a third upper surface, the first upper surface including a water passage port through which the flush water supplied from the water supply unit flows into the storage tank, the second upper surface being lower than the first upper surface, and the third upper surface being provided between the first upper surface and the second upper surface and being lower than the second upper surface, and the storage tank further includes an air vent unit provided at the second upper surface, the air vent unit being configured to purge air from the storage tank.

2. The flush toilet according to claim 1, wherein the storage tank has an asymmetrical shape in a left-right direction so as to include a large tank section and a small tank section, the large tank section being disposed on a large-capacity side of the storage tank when the storage tank is divided into two at a center in the left-right direction, and the small tank section being disposed on a small-capacity side of the storage tank when the storage tank is divided into two at the center in the left-right direction, and the first upper surface is located on an upper surface of the large tank section, and the second upper surface is located on an upper surface of the small tank section.

3. A flush toilet for discharging waste with flush water, the flush toilet comprising:

a toilet main body including a bowl configured to receive waste, and a discharge trap configured to discharge the waste in the bowl; and a tank device configured to supply flush water to the toilet main body, wherein the tank device includes a storage tank provided behind the toilet main body and above a floor surface, the storage tank being configured to store the flush water to be supplied to the toilet main body, the tank device further includes a water supply unit configured to supply the flush water to the storage tank, the storage tank includes a first upper surface and a second upper surface, the first upper surface including a water passage port through which the flush water supplied from the water supply unit flows into the storage tank, and the second upper surface being lower than the first upper surface, and the storage tank further includes an air vent unit provided at the second upper surface, the air vent unit being configured to purge air from the storage tank.

4. The flush toilet according to claim 3, wherein the storage tank has an asymmetrical shape in a left-right direction so as to include a large tank section and a small tank section, the large tank section being disposed on a large-capacity side of the storage tank when the storage tank is divided into two at a center in the left-right direction, and the small tank section being disposed on a small-capacity side of the storage tank when the storage tank is divided into two at the center in the left-right direction, and the first upper surface is located on an upper surface of the large tank section, and the second upper surface is located on an upper surface of the small tank section.

* * * * *